US005510888A

United States Patent [19]

Kuge

[11] Patent Number: 5,510,888

[45] Date of Patent: Apr. 23, 1996

[54] IMAGE FORMING METHOD AND APPARATUS FOR FORMING TWO IMAGES OF TWO ORIGINALS WITH CONTROL OF IMAGE FORMING TIMING AND IMAGE READING TIMING

[75] Inventor: Tadayoshi Kuge, Yokohama, Japan

[73] Assignee: Canon Kabushiki Kaisha, Tokyo, Japan

[21] Appl. No.: 74,739

[22] Filed: Jun. 10, 1993

Related U.S. Application Data

[63] Continuation of Ser. No. 940,754, Sep. 8, 1992, abandoned, which is a continuation of Ser. No. 611,748, Nov. 13, 1990, abandoned.

[30] Foreign Application Priority Data

Nov. 14, 1989 [JP] Japan ..... 1-295436
Nov. 14, 1989 [JP] Japan ..... 1-295437

[51] Int. Cl.[6] ..... G03G 15/00

[52] U.S. Cl. ..... 355/317; 355/309

[58] Field of Search ..... 355/308, 309, 355/313, 316, 317, 320, 202

[56] References Cited

U.S. PATENT DOCUMENTS

| | | | |
|---|---|---|---|
| 4,640,611 | 2/1987 | Ohdake et al. | 355/77 |
| 4,707,126 | 11/1987 | Ohshima et al. . | |
| 4,763,167 | 8/1988 | Watanabe et al. . | |
| 4,831,413 | 5/1989 | Hamakawa | 355/313 |

FOREIGN PATENT DOCUMENTS

| | | | |
|---|---|---|---|
| 0226233 | 6/1987 | European Pat. Off. | G03G 15/00 |
| 1-134472 | 5/1989 | Japan | G03G 15/00 |

*Primary Examiner*—R. L. Moses
*Attorney, Agent, or Firm*—Fitzpatrick, Cella, Harper & Scinto

[57] ABSTRACT

An image forming apparatus is provided which can automatically copy two images of two originals or two images of both surfaces of a single original on a single recording sheet by changing the image forming timing regarding a first original or first surface of an original and a second original or second surface of the same original in a multiple copying machine.

21 Claims, 23 Drawing Sheets

WHEN RDF IS USED

IMAGE FORMING METHOD AND APPARATUS FOR FORMING TWO IMAGES OF TWO ORIGINALS WITH CONTROL OF IMAGE FORMING TIMING AND IMAGE READING TIMING

This application is a continuation of application Ser. No. 07/940,754 filed Sep. 8, 1992, now abandoned, which in turn is a continuation of application Ser. No. 07/611,748 filed Nov. 13, 1990, now abandoned.

BACKGROUND OF THE INVENTION

1. Field of the Invention

The present invention relates to an image forming method and apparatus capable of performing the multiple copying. More specifically, it relates to an image forming method and apparatus which can copy, for example, two images of two originals (or two images of both surfaces of a single original) on a front portion and a rear portion of a single recording sheet, respectively.

2. Related Background Art

In the past, it was possible to copy two images of two originals on a single sheet side by side, only by resting the two originals on a platen side by side. An image forming apparatus which can automatically perform the copying operation in such a mode has not yet been proposed.

When the images of two originals are copied on the single sheet, it is necessary to accurately rest or position the two originals on the platen side by side; thus, in the past, an operator had to pay much attention to the handling of the originals. Further, in case where a large number of originals should be handled, since the operator must repeat the above-mentioned operations many times, he had to spend an extraordinary amount of time.

Further, in the past, in case where two images on both surfaces of a single original are copied on a single sheet side by side, there were no methods other than a method wherein the image on either surface of the original is first copied on a copy sheet (one-surface copy) and then, by resting the copy sheet and the original (the other surface) on the platen side by side, two images are copied on the single sheet.

However, in this case, since the image on either surface of the original has once been copy sheet, such copy sheet was in vain.

Further, since the operator must obtain the copy sheet once and then rest the copy and the original on the platen side by side accurately, he had to spend an extraordinary amount of time.

SUMMARY OF THE INVENTION

The present invention aims to eliminate the above-mentioned drawbacks, and an object of the present invention is to provide an image forming method and apparatus which can automatically form two images of two surfaces of an original on a single sheet side by side.

More particularly, an object of the present invention is to provide an image forming method and apparatus which can automatically copy two images of two originals (or two images of both surfaces of a single original) on a single recording sheet, by changing the image forming timings regarding a first original (or first surface of an original) and a second original (or second surface of the same original) in a multiple copying machine.

According to the present invention, an image forming apparatus comprises an image forming means for forming an image on a sheet, a feeding path for permitting the multiple transfers of the sheet without ejecting the sheet out of the apparatus, and an original stacking means on which originals are stacked, and further comprises a control means for performing the formation of the image on the sheet at any timing, and an instruction means for instructing to form the images of two originals on the sheet side by side, by changing the image forming timing by means of the control means.

With this arrangement, the images of the two originals can be copied on the single sheet side by side by changing the image forming timing.

According to the present invention, since the images of the two originals are copied on the single sheet side by side, it is possible to eliminate the effort or labor that an operator must accurately position the two originals on the platen (original support means).

Further, since the images of the two originals can be copied on the single sheet with left and right images being changed, the present invention can be adopted to make books bound both in Japanese style and in European style.

In addition, since the images of a plurality of originals can be copied on sheets in such a manner that two images of each two originals are successively copied on the respective sheet by using the automatic original conveying apparatus, the operator's labor can be considerably reduced.

Furthermore, according to the present invention, since the images on front and rear surfaces of each original can be automatically copied on front and rear portions of the single sheet, the operator's labor can be considerably reduced and the useless copies can be avoided.

BRIEF DESCRIPTION OF THE DRAWINGS

FIG. 10 is a flow chart of a sheet supply operation to the regist roller ON;

DESCRIPTION OF THE PREFERRED EMBODIMENTS

The present invention will now be explained in connection with embodiments thereof with reference to the accompanying drawings.

Figure 2:
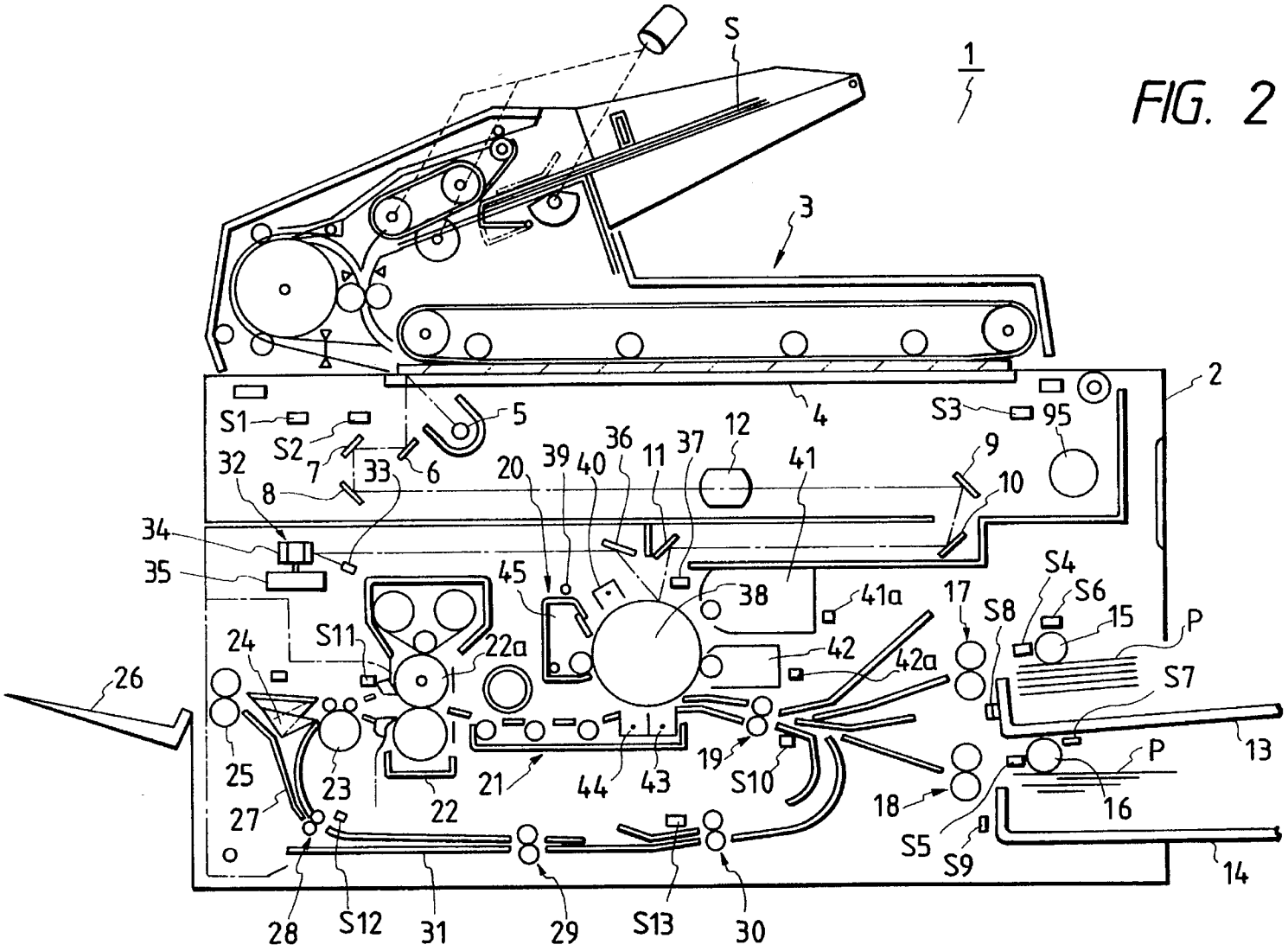
FIG. 2 is an elevational cross-sectional view of the whole image forming apparatus.

A preferred embodiment of the present invention is shown in FIG. 2. The reference numeral 1 denotes a copying machine; reference numeral 2 denotes a frame of the copying machine; and reference numeral 3 denotes a circulating original conveying apparatus (referred to as "RDF" hereinafter) for automatically conveying or feeding originals, which is detachably connected to the copying machine.

The copying machine 1 includes a platen 4, a light source 5, mirrors 6, 7, 8, 9, 10, 11, a lens 12, and cassettes 13, 14 for accommodating sheets. Sheet supply rollers 15 and 16 are arranged above the cassettes 13 and 14, respectively. At an upper and left portion of the frame 2, there are arranged a home position sensor $S_1$ for detecting a home position of an optical system such as the light source 5 and mirrors 6, 7, 8, and an image top end sensor $S_2$ disposed in correspondence to a position of a leading end of an original rested on the platen 4. At an upper and right portion of the frame 2, a sensor $S_3$, for detecting the maximum shifting position of the optical system is arranged.

Further, in the vicinity of the cassettes 13 and 14, there are arranged sheet presence/absence sensors $S_4$, $S_5$ for detecting the presence/absence of the sheets P, lifter sensors $S_6$, $S_7$ for detecting position of the lifters (not shown) of the cassettes 13, 14 and sheet size sensors $S_8$, $S_9$ for detecting the sizes of sheets contained in the cassettes 13, 14.

At a downstream side of the supply rollers 15 and 16, there are disposed pairs of conveying rollers 17, 18, at a downstream side of which there are arranged a sheet sensor $S_{10}$ for detecting the sheet P and a pair of register rollers 19. Further, at a downstream side of the paired regist rollers 19, there is disposed a copying portion 20, at a downstream side of which there are arranged a conveying device 21 and a fixing device 22 incorporating a heater **22*a*** therein.

At a downstream side of the fixing device 22, there are disposed a sheet discharge sensor $S_{11}$, a conveying roller 23, a flapper 24 and sheet discharge or ejector rollers 25, and a sheet discharge tray or ejector tray 26 is disposed at a downstream side of the ejector rollers 25.

Further, a re-feeding path 27 is branched from the flapper 24, which re-feeding path includes a pair of conveying rollers 28, a sheet sensor $S_{12}$, a pair of reverse rollers 29, a sheet sensor $S_{13}$, a pair of re-supplying rollers 30 and an intermediate tray 31. Incidentally, the reverse rollers 29 are driven by a stepping motor (not shown) to convey the sheet in both upstream and downstream directions.

A laser unit 32 is disposed within the frame 2, which laser unit includes a laser beam emitting portion 33, a polygonal mirror 34, a polygon motor 35 and a mirror 36. Incidentally, the reference numeral 37 denotes a shutter for blocking light projected on the copying portion 20. Further, the copying portion 20 is provided with a cylindrical photosensitive drum 38 around which there are disposed an erase lamp 39, a primary charger 40, a color developing device 41, a black developing device 42, a transfer charger 43, a separation charger 44 and a cleaner 45. Incidentally, the reference numeral **41*a* denotes a solenoid for urging the color developing device; and 42*a*** denotes a solenoid for releasing the black developing device.

Figure 3:
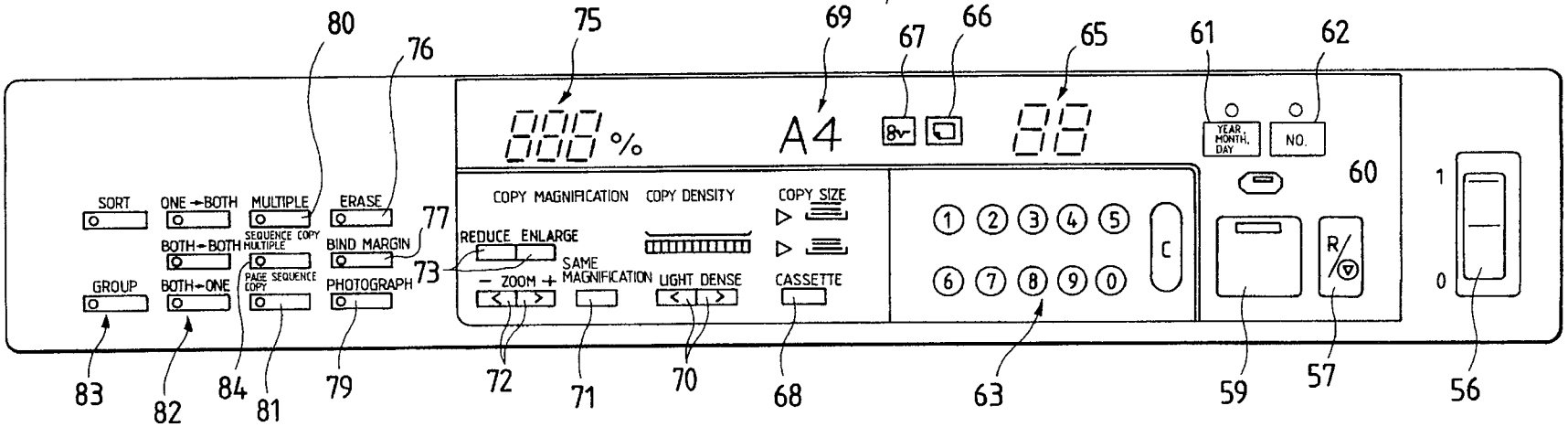
FIG. 3 is a plan view of an operation portion of the image forming apparatus.

On the other hand, as shown in FIG. 3, the copying machine 1 has an operation portion 55 which includes a power source switch 56 at its right end, and a reset/stop key 57 and a start key 59 are disposed at the left of the power source switch. A color developing device selection switching key 60, a date (year, month, day) instructing key 61 for instructing a date writing mode, and a number instructing key 62 for instructing the writing of the number are arranged above the start key 59. A ten-key 63 is arranged at the left of the start key 59.

Further, above the ten-key 63, there are arranged a copy sheet number indicator 65 for displaying the number of copy sheets (to be obtained) inputted by the ten-key 63, a sheet absence indicator 66 for indicating the alarm for the absence of the sheet and a jam alarm indicator 67 for detecting the occurrence of the jamming of the sheet. A selection key 68 for selecting the cassette 13 or cassette 14 and a cassette indicator 69 for indicating the cassette size are arranged at the left of the ten-key 63.

Further, at the left of the selection key 68, there are arranged a copy density adjusting key 70, a same magnification key 71, a zoom key 72 for selecting the copy magnification to a desired magnification per 1%, and a fixed form magnification key 73 for instructing the fixed form reduction or fixed form enlargement. At the left of the zoom key 72, there are arranged various instruction keys including an instruction key for instructing the erasing of a frame of the copy sheet, an instruction key 77 for instructing the formation of a bind margin in one end of the sheet, an instruction key 79 for instructing a photograph mode, a multiple key 80 for selecting a multiple mode, a page sequence copy key 81 for instructing a page sequence copying operation, a both-face copy key 82 for selecting a both-face copy mode, an instruction key 83 for instructing an operation mode (sort mode or group mode) of a sorter 85 shown in FIG. 1, and a key 84 for selecting a sequence page copy multiple mode which will be described later.

Figure 1:
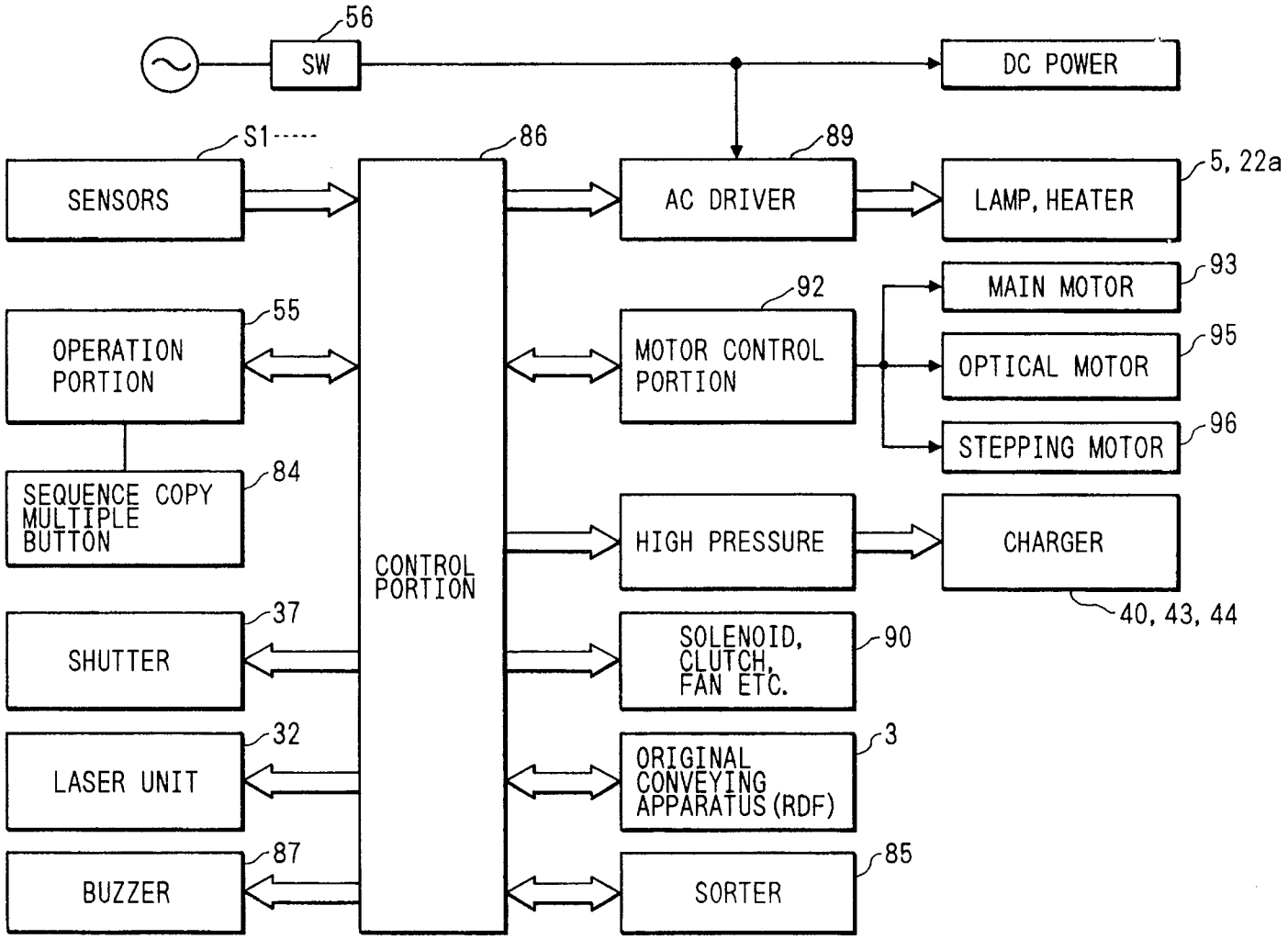
FIG. 1 is a block diagram of a controlling portion of an image forming apparatus according to a preferred embodiment of the present invention.

On the other hand, as shown in FIG. 1, the copying machine 1 is provided with a control portion 86 which is constituted by a microcomputer, ROM, RAM, timer and the like. All of the sensors $S_1$, $S_2$, . . . are connected to input portions of the control portion 86. To output portions of the control portion 86, there are connected the laser unit 32, shutter 37, buzzer 87, AC loads such as the lamp 5 and heater 22*a* through an AC driver 89, various chargers 40, 43, 44 through a high pressure generating device HVT, and a load 90 such as the solenoid, clutch, fan and the like. Further, to the input portions of the control portion 86, there are connected the operation portion 55, sorter 85, original conveying apparatus 3, and main motor 93 and optical motor 95 and stepping motor 96 through a motor control portion 92.

Next, the RDF will be described with reference to FIG. 4.

The RDF includes a stacking tray 100 on which originals are stacked as an original stack S. In case of one-face original (original only on one face of which an image is formed), by driving a separation motor 101, the original is separated one by one from the bottom of the original stack S by means of a semi-circular roller 102, separating and conveying roller 103 and separating belt 104, and, by driving a belt motor 105, the original is conveyed to an exposure position on the glass platen 4 through paths I–II by means of a pair of register rollers 106*a*, 106*b* and whole-surface belt 107, and then the original is stopped there. Thereafter, a copying operation is started. After the copying operation has been finished, the original is fed to a path III by the belt 107 and is fed to a path IV by a large conveying roller 108, and then is returned to onto the original stack S by an ejector roller 109. A recycle lever 110 is provided for detecting one circulation of the originals and is rested on the original stack S upon the initiation of the supply of the originals so that, when a trailing end of the last original passes through the recycle lever, the latter is dropped by its own weight, thus detecting one circulation of the originals.

Figure 4:
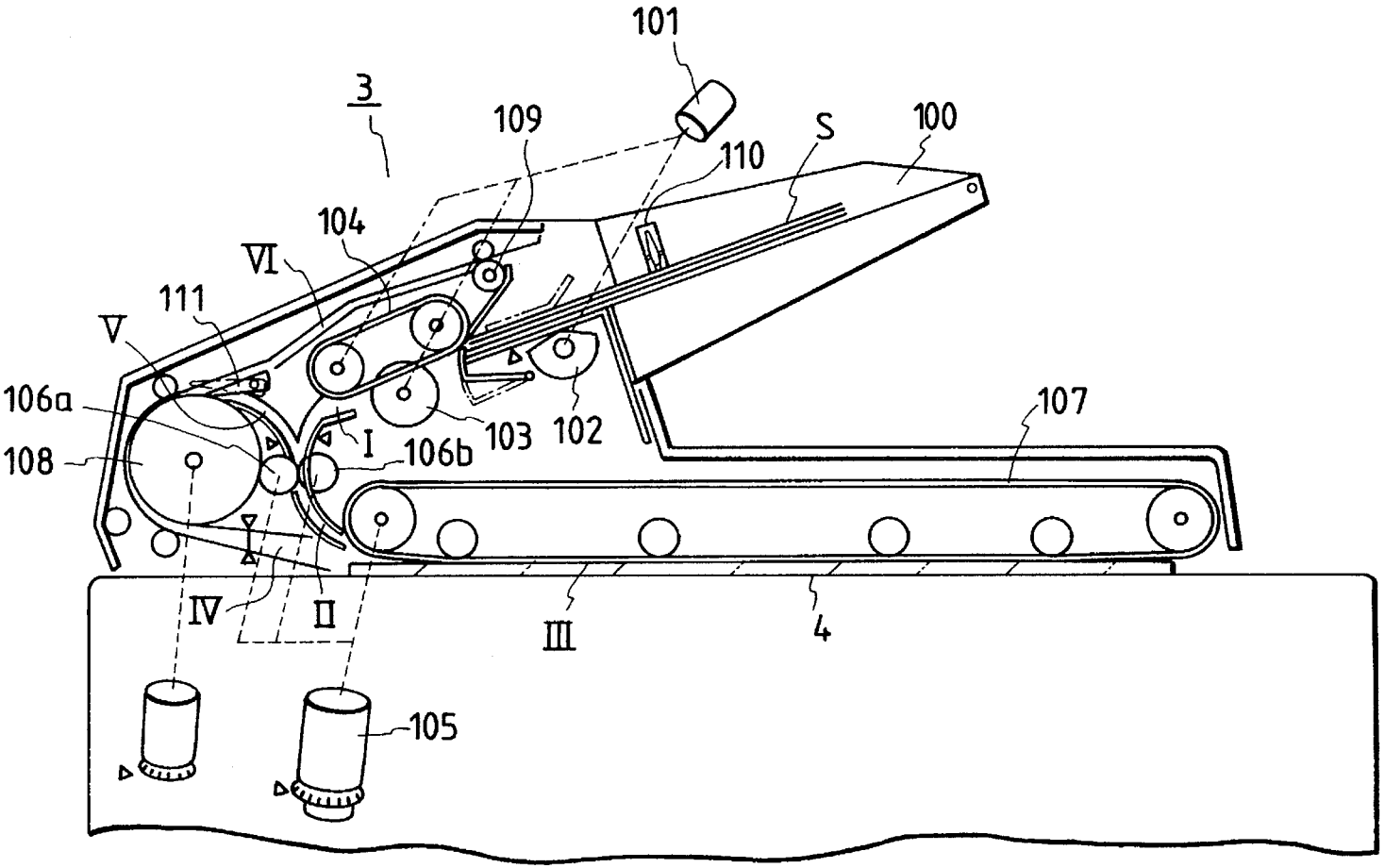
FIG. 4 is an elevational cross-sectional view of an original conveying apparatus of the image forming apparatus.

Next, in case of a both-face copying operation, as mentioned above, the original is once directed from the paths I, II to the path III, and then, by activating a flapper solenoid (not shown) to switch-over a rockable flapper 111 to a position shown by a phantom line in FIG. 4, a leading end of the original is directed from the path IV to a path V, and thereafter the original is conveyed to the space (path III) between the whole-surface belt 107 and the glass platen 4 through the path II by means of the pair of register rollers 106*a*, 106*b*, and then is stopped there. That is to say, by means of the large conveying roller 108, the original is reversed (turned over) in the paths III~IV~V~II.

Further, by conveying the original one by one through the paths I~II~III~IV until the one circulation of the originals is detected by the recycle lever 110, it is possible to count the number of the originals.

Next, an operation of the image forming apparatus according to the preferred embodiment of the present invention will be explained.

When the power source switch 56 is turned ON, the control portion 86 energizes the heater 22*a* of the fixing device 22. When the temperature of the fixing device reaches 190° C., the main motor 93 is rotated, After one revolution of the photosensitive drum 38 is finished, the control portion 86 stops the main motor 93. Now, the copying machine 1 becomes a copy permitting condition (stand-by condition).

Figure 5:
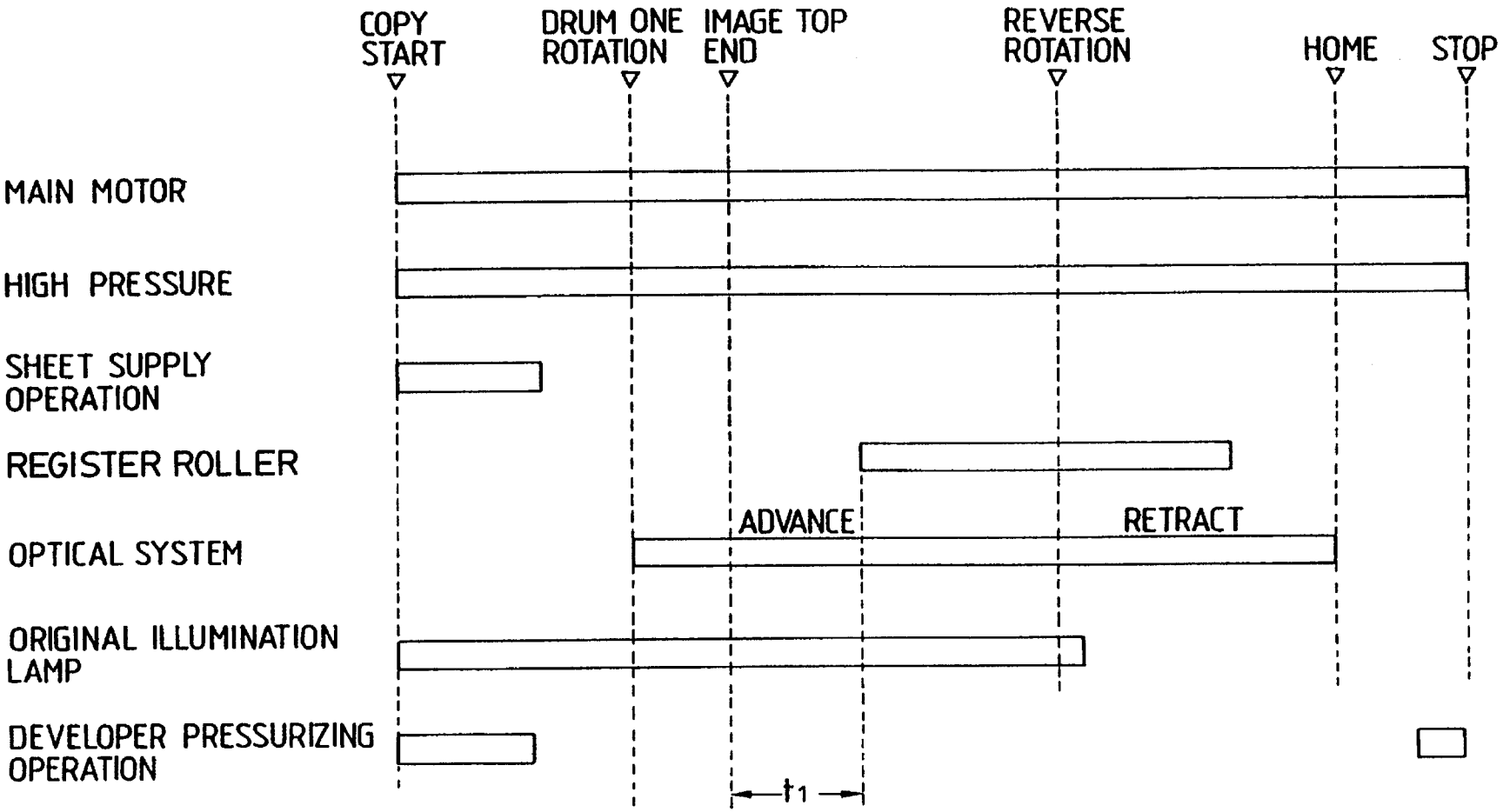
FIG. 5 is a timing chart for forming images by means of the image forming apparatus.

When the start key 59 is depressed, as shown in FIG. 5, the control portion 86 activates the main motor 93, high pressure generating device and original conveying apparatus 3, and also activates a clutch (not shown) for the sheet supply roller 15 or 16 after an intermediate plate of the cassette 13 or 14 has been lifted, thereby supplying the sheet. When a predetermined time is elapsed after the sheet sensor $S_{10}$ has detected the sheet P, the sheet P is abutted against the pair of register rollers 19 to form a loop therein. At that time, the clutch is deactivated.

When the fact that the substantially one revolution of the photosensitive drum 38 uniformly charged by the primary charger 40 is attained by the main motor 93 is detected by a sensor (not shown), the control portion 86 turns the lamp 5 ON and also activates the optical motor 95 to advance the optical system such as the lamp 5, mirror 6 and the like for exposure scanning the original rested on the platen 4. When a predetermined time $t_1$ has elapsed after the image top end sensor $S_2$ has detected the image top end, the pair of register rollers 19 are activated. The control portion 86 activates the sheet supply clutch for a predetermined time period, as well as the activation of the register rollers 19, whereby the sheet P is further conveyed by rotating the sheet supply roller 15 or 16 again. Further, the pair of register rollers 19 are rotated for a time corresponding to the size of the sheet. In this case, the sheet pinched by the paired register rollers 19 is conveyed in synchronism with an image visualized on the photosensitive drum 38. Incidentally, while the original is being scanned by the optical system, it is possible to erase any portion of the image by means of the laser unit 32, thus permitting the writing of simple characters such as year, month, day and number.

The image on the photosensitive drum 38 is transferred onto the sheet P by the transfer charger 43, and then the sheet is separated from the photosensitive drum 38 by the separation charger 44. In this case, when the optical system such as the lamp 5, mirror 6 and the like is detected by the sensor $S_3$, the optical system is reversed to return to its home position. The sheet P onto which the image was transferred is conveyed to the fixing device 22 by means of the conveying device 21, and the image is fixed to the sheet by the fixing device 22. Further, the sheet P is conveyed to the flapper 24 by the conveying roller 23, and then is guided up to the sheet discharge rollers 25, and thereafter is ejected onto the ejector tray 26.

Next, the multiple copy mode will be explained.

Figure 6:
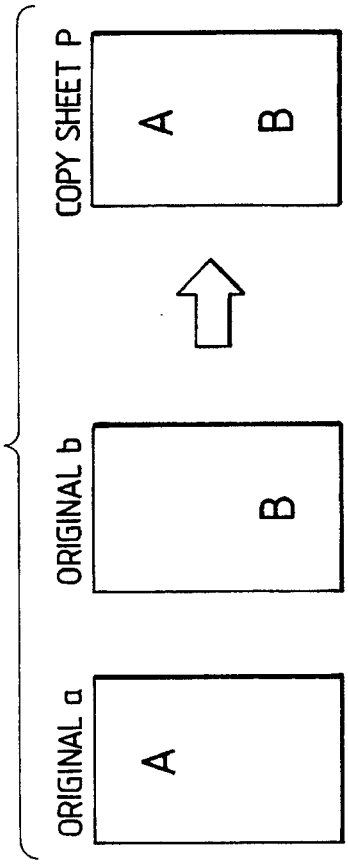
FIG. 6 is an explanatory view for explaining a general dual copying operation.
Figure 7A:
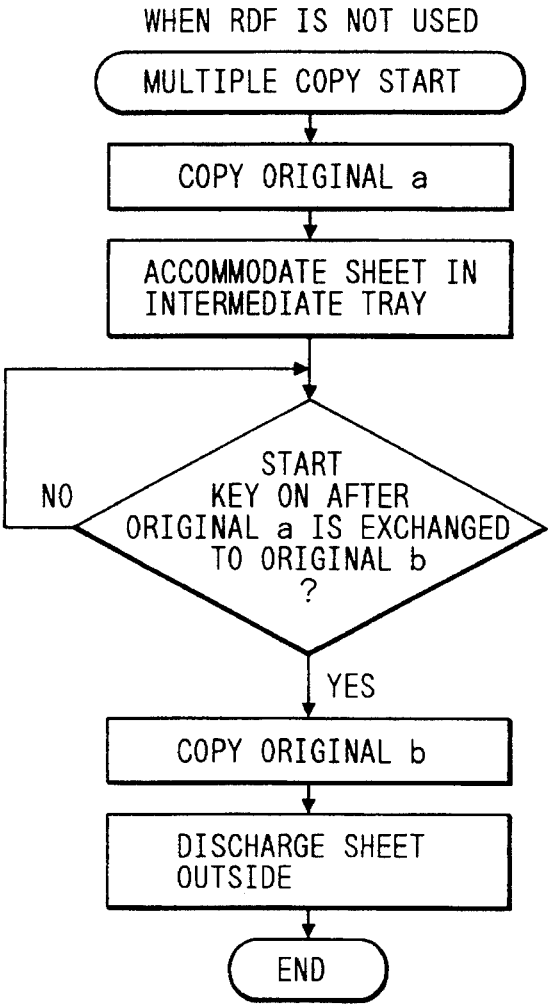
FIG. 7A is a flow chart when an RDF is not used.
Figure 7B:
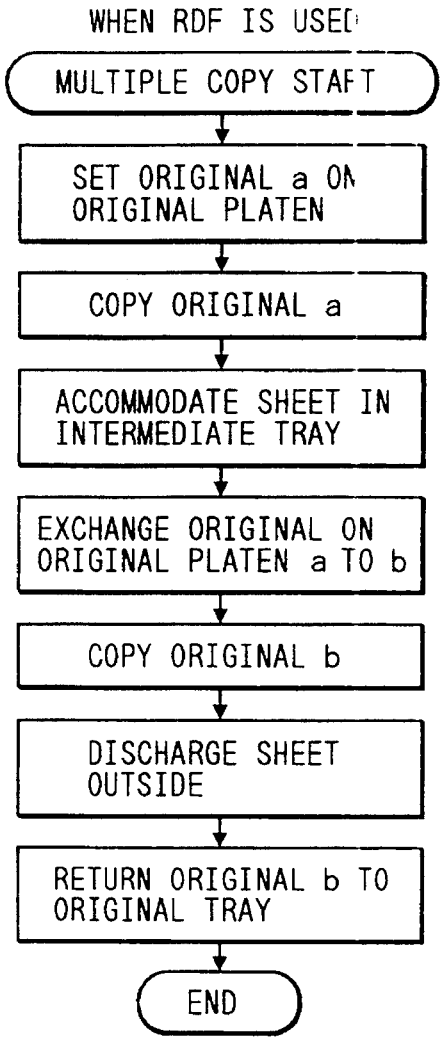
FIG. 7B is a flow chart when the RDF is used.
Figure 8:
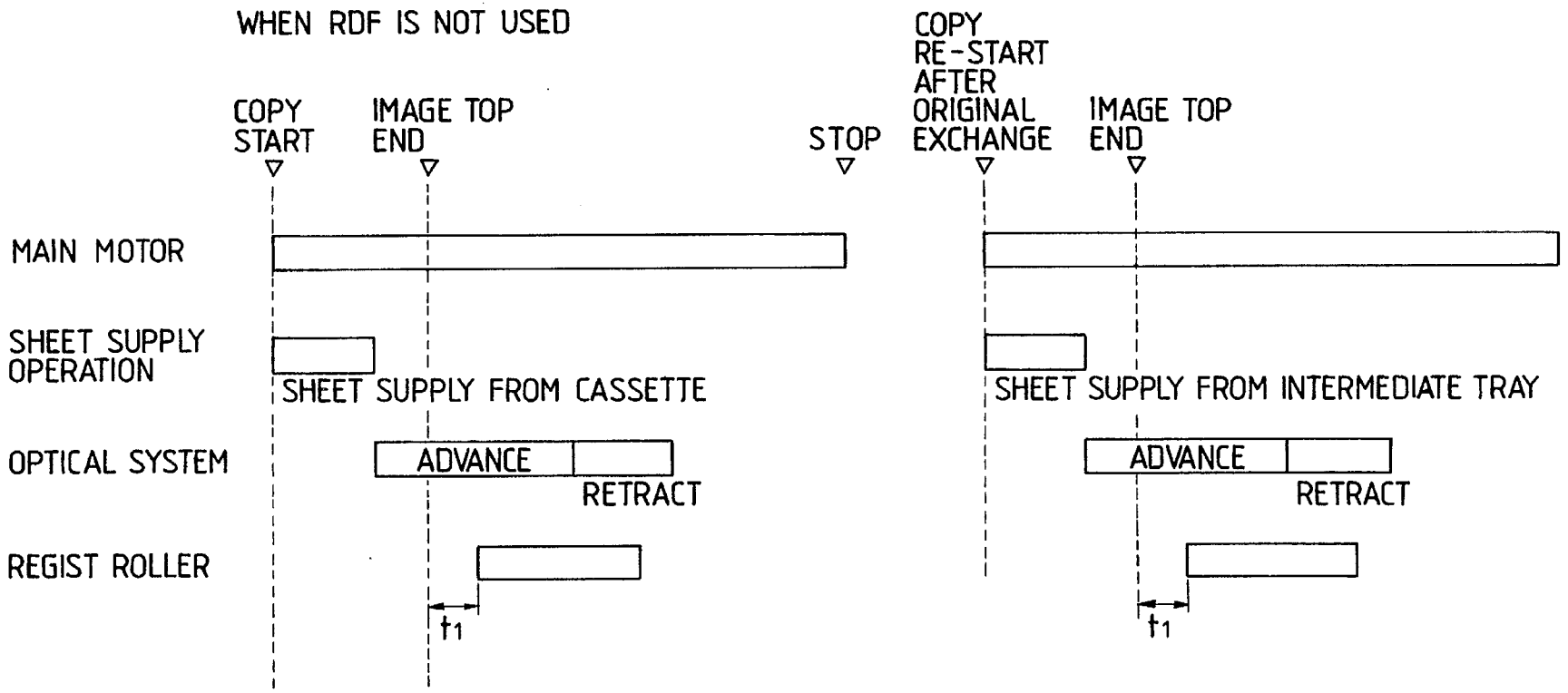
FIG. 8 is a timing chart of a general copying operation when the RDF is not used.
Figure 9:
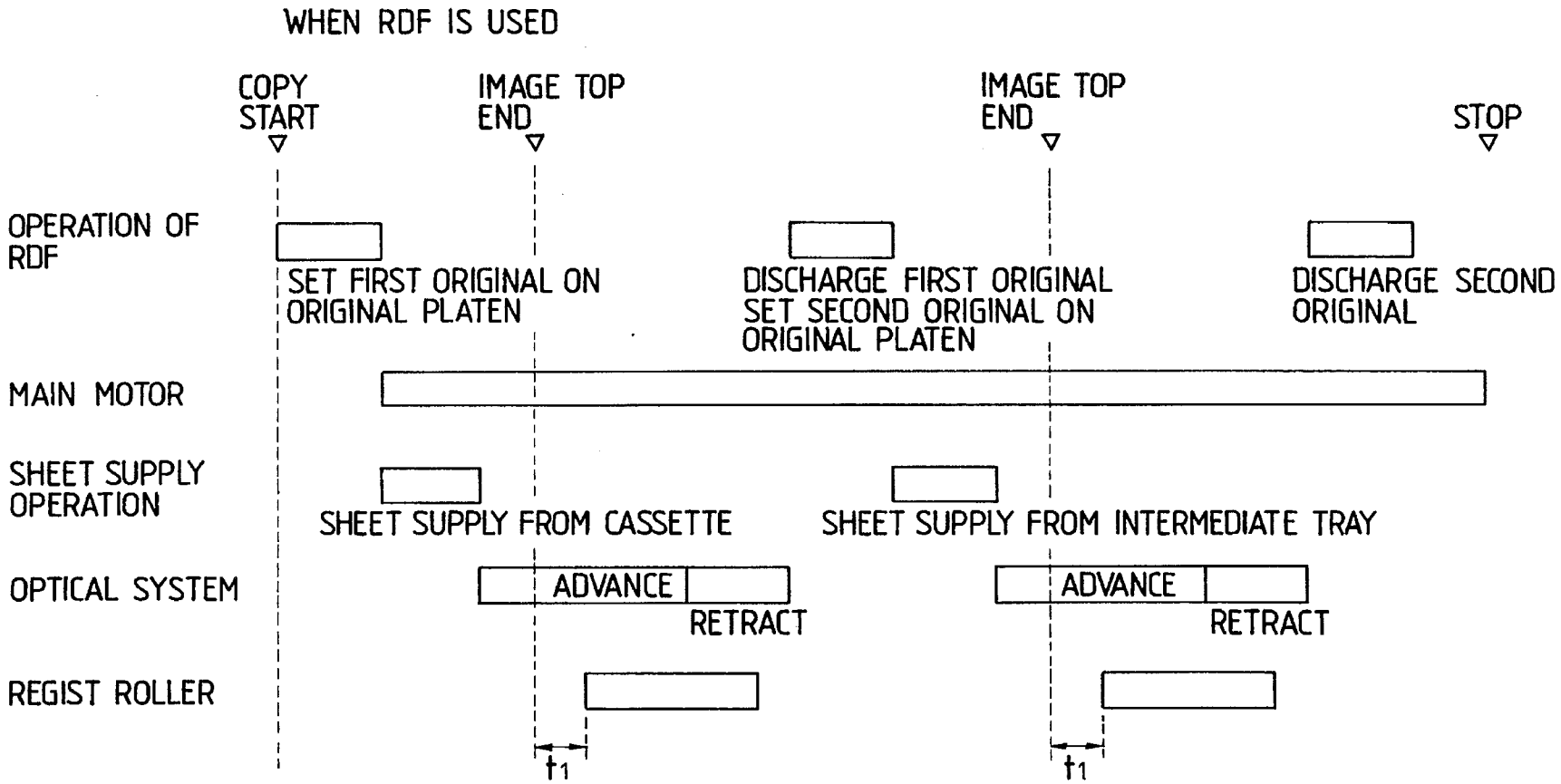
FIG. 9 is a timing chart of a general copying operation when the RDF is used.

In a normal multiple copy mode, as shown in FIG. 6, the images are copied on the sheet P from the originals a and b. As shown in FIGS. 7A and 7B, in the multiple copy mode, the image of the first original a is copied on the sheet, and the sheet P is retained on the intermediate tray 31, and thereafter the image of the second original is copied on the same sheet P re-fed from the intermediate tray 31. A timing chart for such sequence (in case where the RDF is not used) is shown in FIG. 8, and a similar timing chart (in case where the RDF is used) is shown in FIG. 9.

Figure 10:
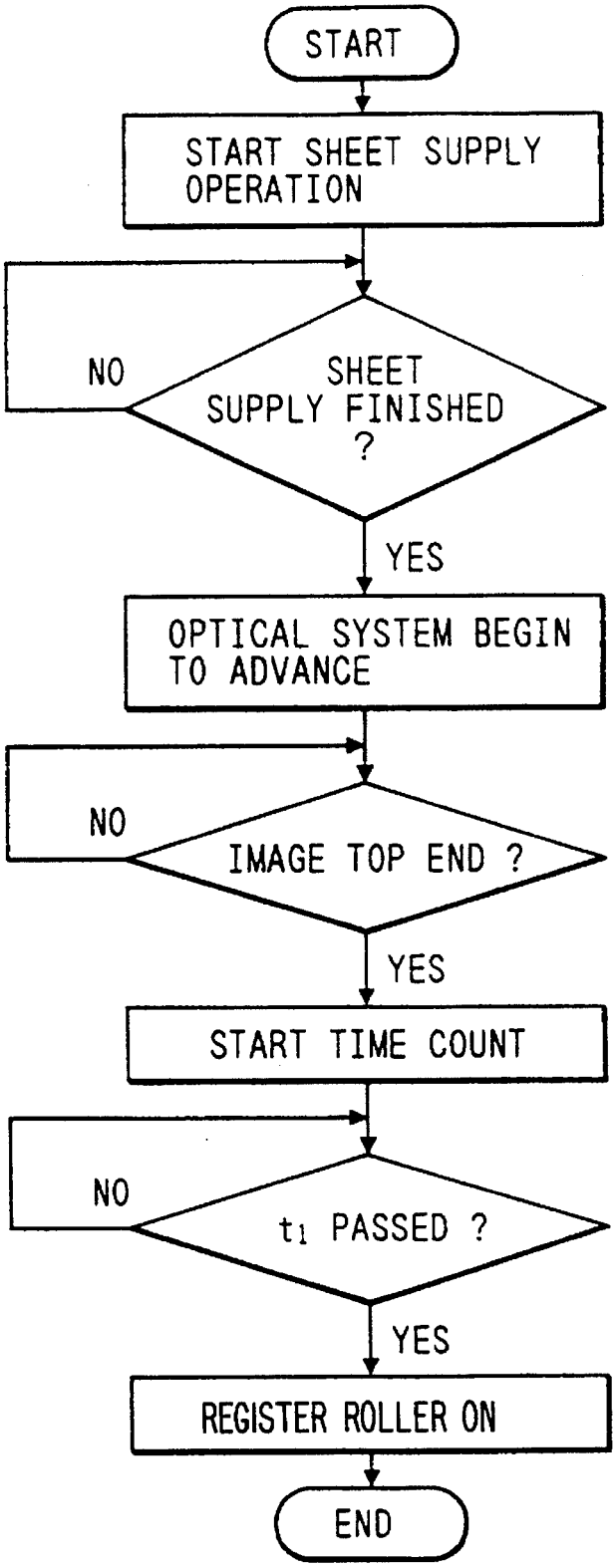

When the RDF is not used, the supplying of the sheet is started by depressing the copy start key. When the sheet supplying operation has been finished, the optical system is started to advance. When an image top end signal is emitted from the sensor $S_2$, the control portion 86 counts the time. When the control portion 86 counts the elapsed time $t_1$, the control portion 86 activates the pair of register rollers 19 so that the image formed on the photosensitive drum 38 is moved in synchronism with the conveying of the sheet P. A flow chart from the start of the sheet supply operation to the activation of the register rollers 19 is shown in FIG. 10. Regarding the sequence from the initiation of the sheet supply operation to the start of the activation of the register rollers 19 shown in the flow chart, both first and second surfaces of the multiple copy can be handled in the same manner as the normal one-face copy operation.

Next, the sequence page copy multiple mode selected by the key 84 will be explained.

Figure 12:
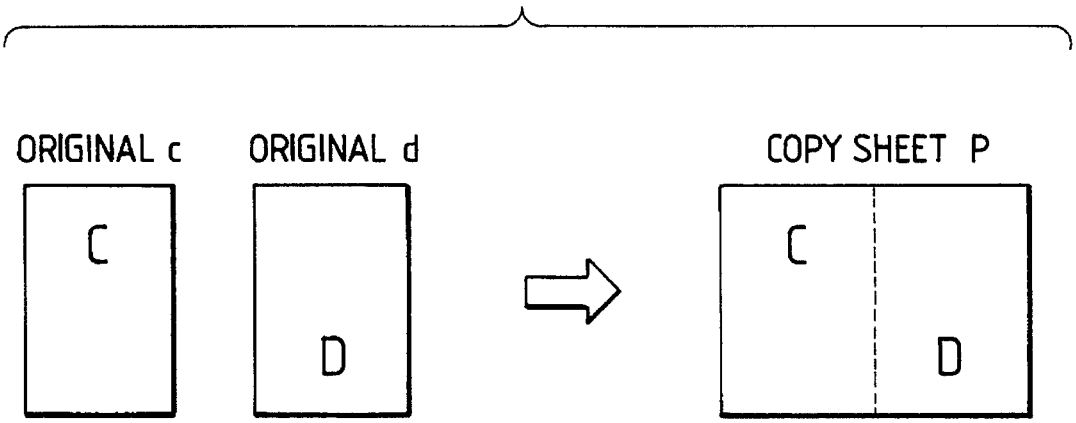
FIG. 12 is an explanatory view for explaining the image forming operation in a sequence page copy multiple mode.

As shown in FIG. 12, in the sequence page copy multiple mode, the images are copied on the sheet P from the originals c and d. That is to say, the image of the original c is copied on a front portion of the sheet P and the image of the original d is copied on a rear portion of the sheet P with the images of two originals being offset between the front and rear portions of the sheet P.

Figure 11:
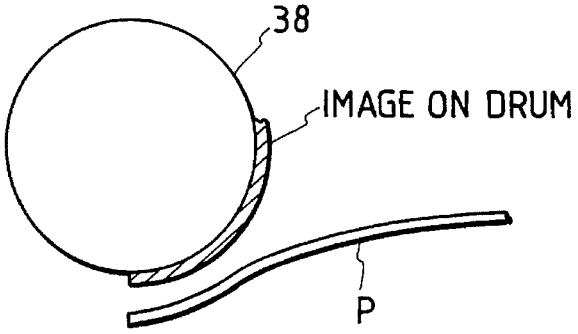
FIG. 11 is an explanatory view showing the relation between a sheet and a photosensitive drum in such a case.
Figure 13A:
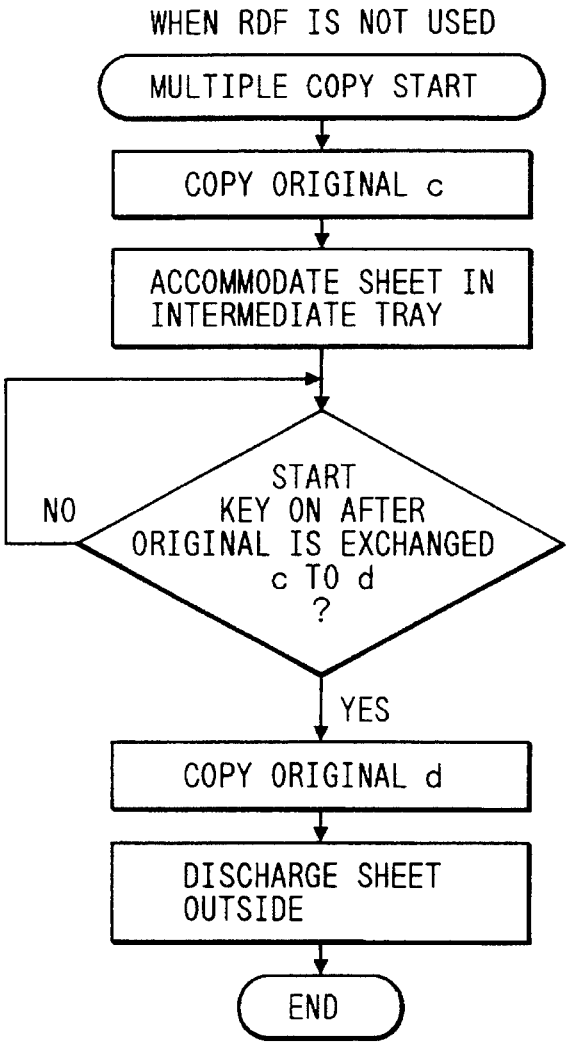
FIG. 13A is a flow chart of the sequence page copy multiple mode when the RDF is not used.
Figure 13B:
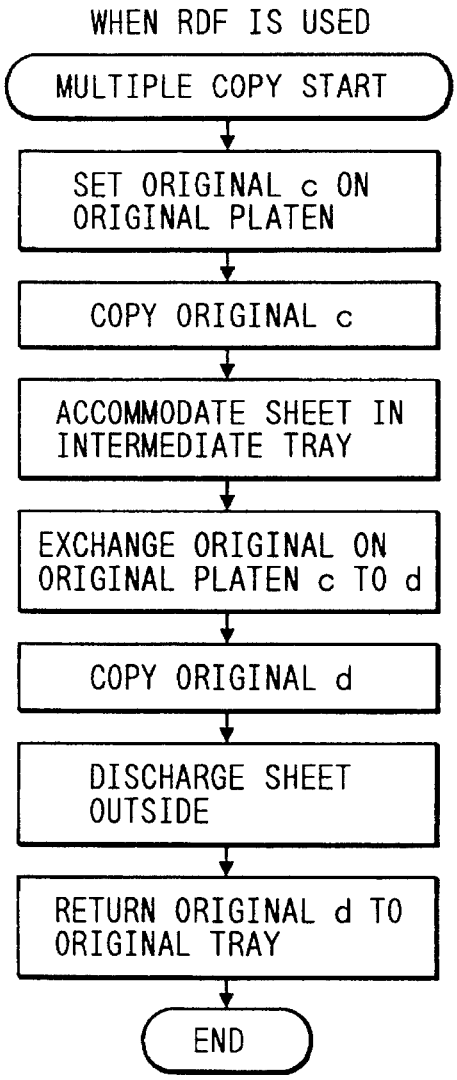
FIG. 13B is a flow chart of the sequence page copy multiple mode when the RDF is used.

A flow chart for performing the sequence page copy multiple mode is similar to that of the normal multiple copy mode, and such flow chart effected when the RDF is not used is shown in FIG. 13A and the flow chart effected when the RDF is used is shown in FIG. 13B. More particularly, when the sheet supplying operation has been finished, the optical system is started to advance. When the image top end signal is emitted from the sensor $S_2$, after a predetermined time $t_1$ has been elapsed, the control portion 86 activates the pair of register rollers 19 so as to control the leading end of the image formed on the photosensitive drum 38 being aligned with a leading end of the sheet P (see FIGS. 11 and 12).

Figure 14:
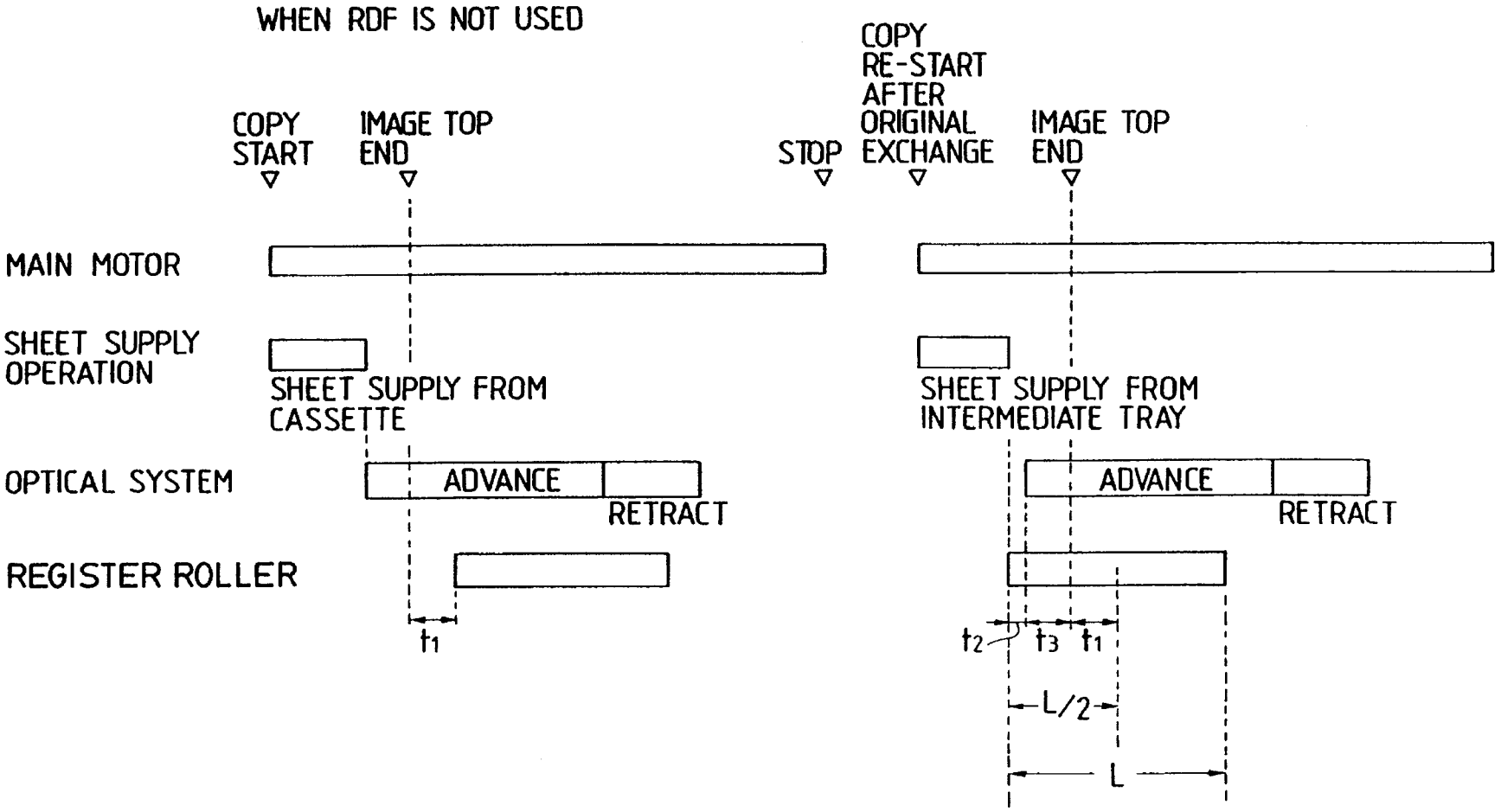
FIG. 14 is a timing chart of the sequence page copy multiple mode when the RDF is not used.

Next, the second face copying operation will be explained with reference to FIGS. 14 and 15.

Figure 16:
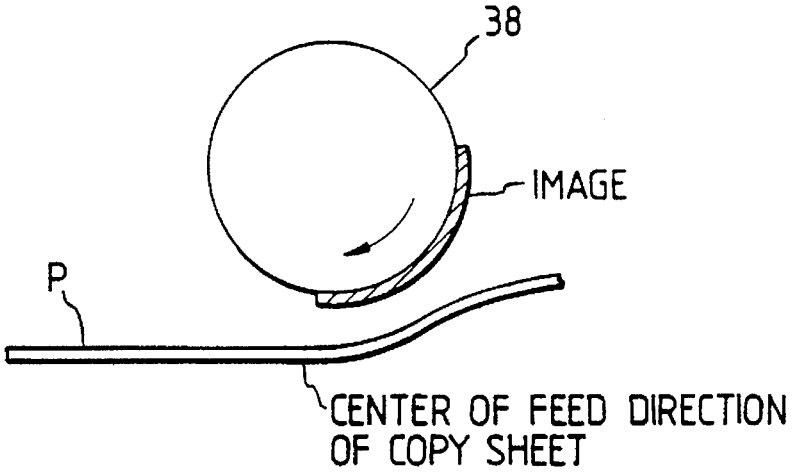
FIG. 16 is an explanatory view showing the relation between a sheet and a photosensitive drum in such a case.

When the copying machine is re-started after the originals has been exchanged or when the exchange of the originals performed by the RDF 3 is completed, the re-supplying of the sheet from the intermediate tray 31 is effected. When the re-supplying operation is finished, the register rollers 19 are activated to feed the sheet P to the copying portion 20. After a predetermined time $t_2$ has elapsed, the optical system starts to advance, and the optical system and the register rollers 19 are controlled so that the image is transferred on the rear portion of the sheet P, as will be described later. In this case, the positional relation between the image formed on the photosensitive drum 38 and the sheet P is shown in FIG. 16. As shown in FIG. 16, the sheet P precedes the image on the photosensitive drum 38.

Now, the time $t_2$ between the activation of the register rollers 19 and the initiation of the advancement of the optical system will be explained. Since a time $t_3$ from the initiation of the advancement of the optical system (emission of OFF signal from the home position sensor $S_1$) to the detection of the fact that the optical system is positioned at the image top end position by means of the sensor $S_2$ is a time previously set regarding the optical system, and a time $(t_1+t_2+t_3)$ corresponds to a time when the sheet is conveyed by the register S rollers by a half (L/2) of the length (L) of the sheet P and has a value previously set, and further, as mentioned above, the time $t_1$ corresponds to the time from the emission of the signal from the image top end sensor $S_2$ to the activation of the register rollers 19, the time $t_2$, i.e., the time from the activation of the register rollers 19 to the initiation of the advancement of the optical system can easily be set.

Incidentally, when the copy magnification is changed, the time $t_3$ from the initiation of the advancement of the optical system to the detection of the fact that the optical system is positioned at the image top end position by means of the sensor $S_2$ is also varied. Consequently, it is apparent that the time $t_2$ is also varied. Further, if a DC motor is used to drive the optical system, the time $t_3$ is dispersed more or less; however, if a stepping motor is used to drive the optical system, since the time $t_3$ can be known accurately, the image can be correctly copied on the rear portion of the sheet P.

In order to set the time $t_3$, a time from the initiation of the advancement of the optical system to the detection of the image top end by means of the sensor $S_2$ is previously measured, and the measured data is stored in the control portion 86. Alternatively, the time $t_3$ can be calculated by the control portion 86 on the basis of the building-up feature of the optical system. If the stepping motor is used to drive the optical system, since the time $t_3$ can be previously calculated regarding each of the copy magnification, by storing the calculated values in the control portion 86, the calculation of the time can be omitted during the copying operation.

Figure 17:
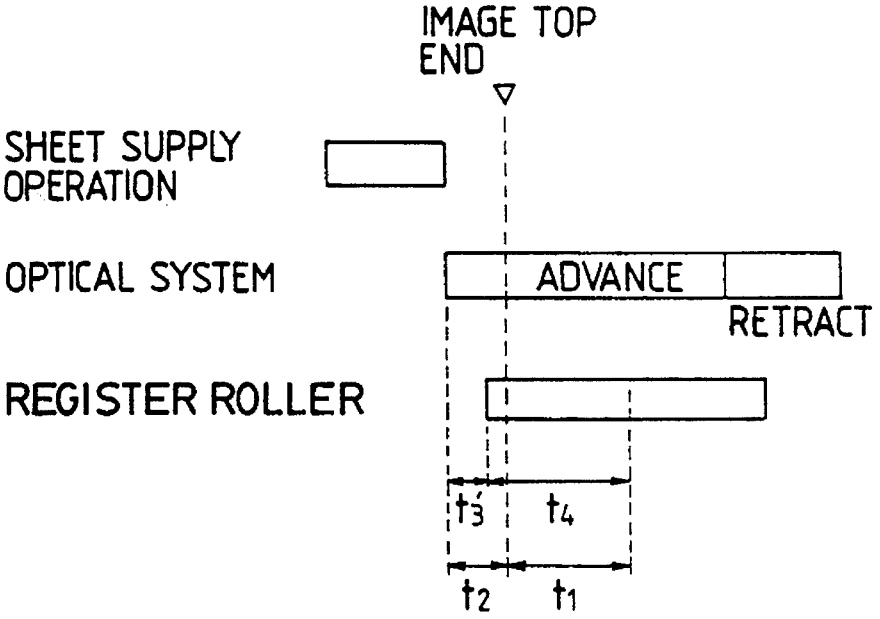
FIG. 17 is a timing chart when a copy magnification is changed.

Further, as shown in FIG. 17, in accordance with the copy magnification, in some cases, the timing of the initiation of the advancement of the optical system will be faster than the timing of the activation of the register rollers 19; however, since the position onto which the image is transferred is already known (i.e., a central portion of the sheet P) and the aforementioned times $t_1$, $t_2$ are also known a time $t'_3$ (the time difference between the initiation of the advancement of the optical system and the activation of the register rollers 19) can be sought by calculating a time $t_4$ required to feed the sheet by the half of the length of the sheet P by means of the register rollers 19.

In this way, the copy sheet as shown in FIG. 12 can be correctly obtained.

Figure 18:
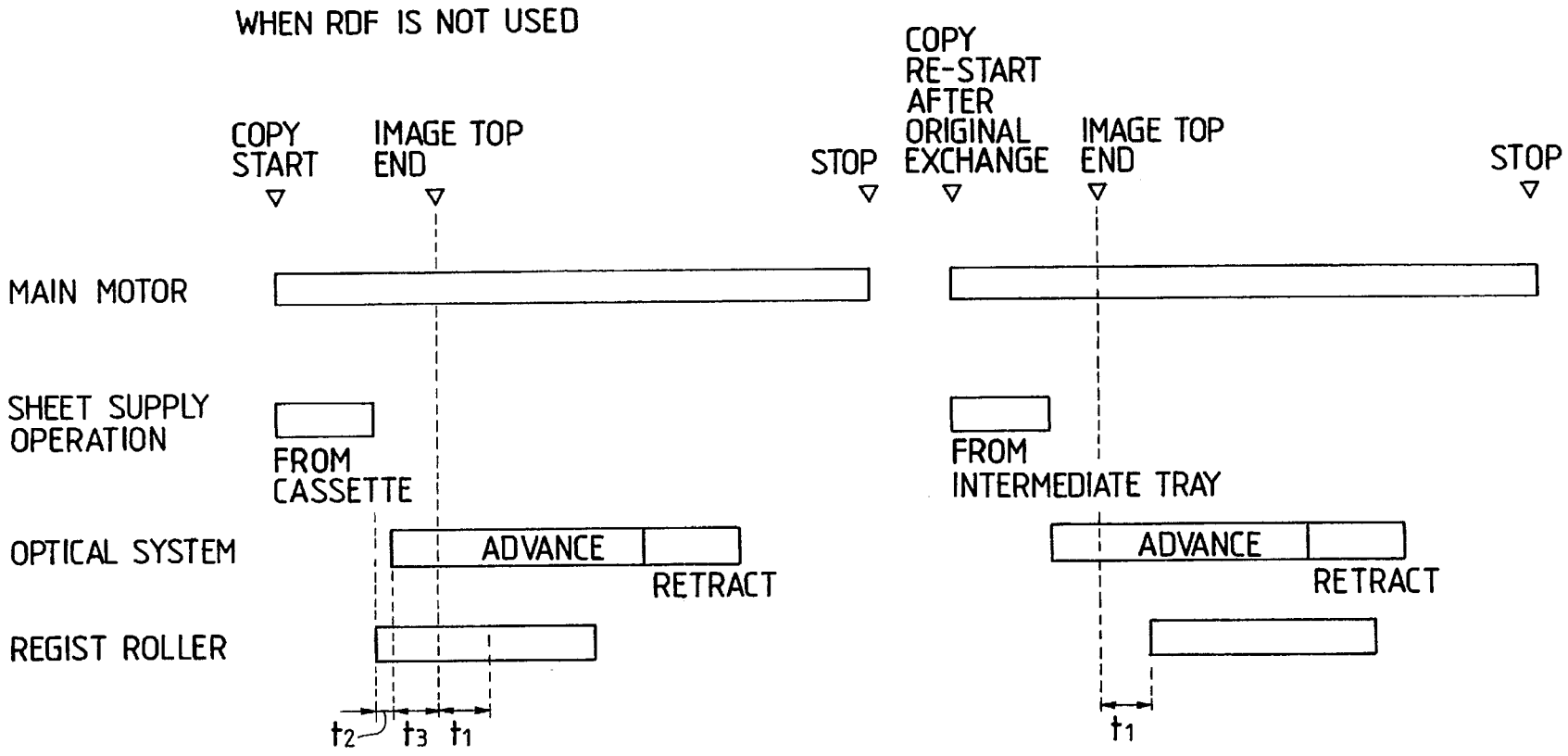
FIG. 18 is a timing chart in case where the sequence of first and second originals is reversed in left and right when the RDF is not used.
Figure 19:
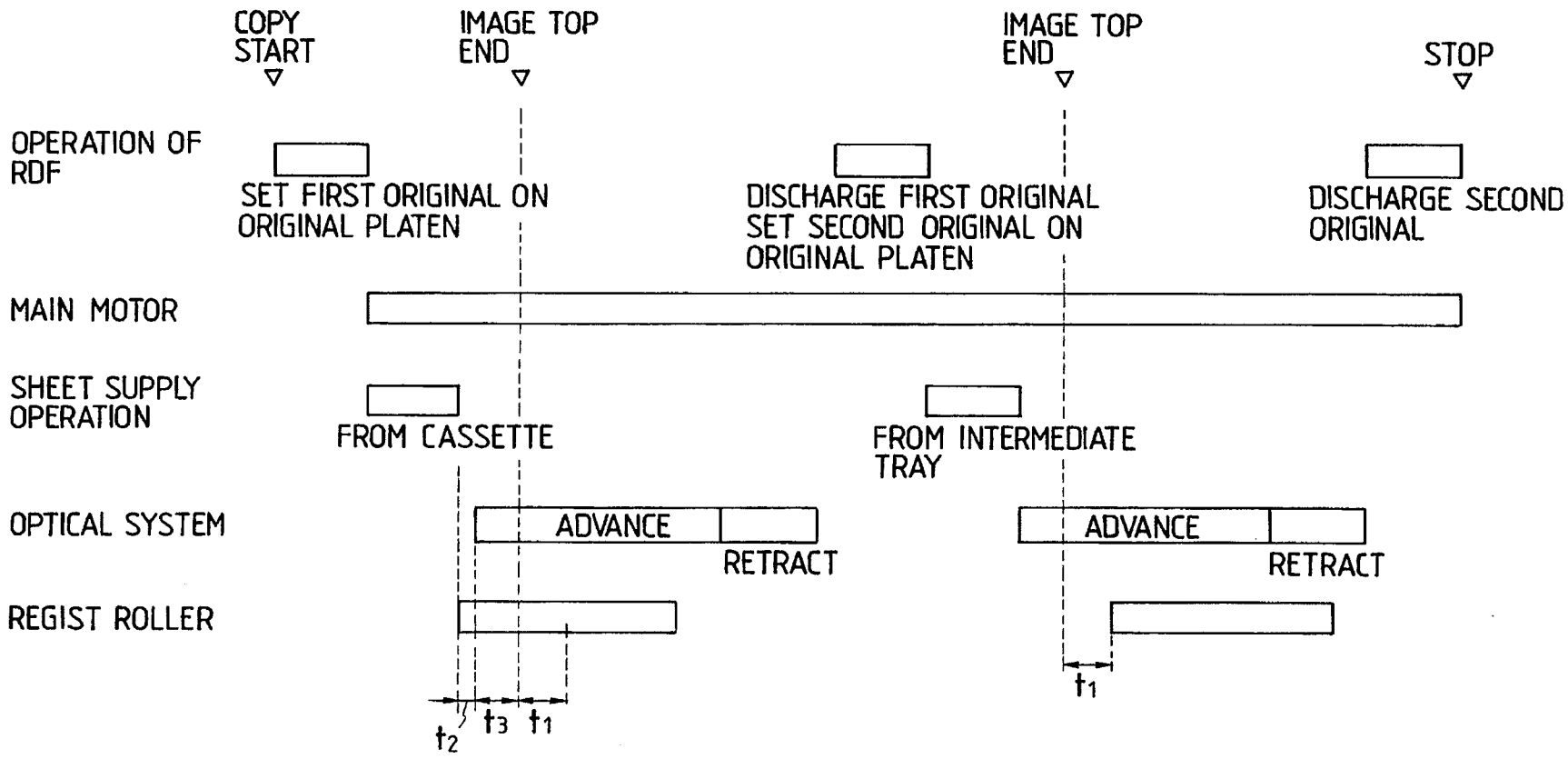
FIG. 19 is a timing chart in case where the sequence of first and second originals is reversed in left and right when the RDF is used.

While an example that the sequence page copy multiple mode is effected by shifting the timing of the copying operation regarding the second surface in the multiple copy was explained, the sequence page copy multiple mode can be effected by shifting the timing of the copying operation regarding the first surface in the multiple copy. A timing chart when the RDF is not used is shown in FIG. 18, and a timing chart when the RDF is used is shown in FIG. 19. By doing so, a copy sheet P as shown in FIG. 20 can be obtained.

Further, although not illustrated in the timing charts, undesired portions of the image can be erased by the laser unit 32. Explaining with reference to FIG. 12, when the image of the original c (although illustrated as an original having A4 size, in case of an original having A3 size) is copied, a portion of the image of the original having A3 size which corresponds to the right half area of the copy sheet P is erased, and, similarly, when the image of the original d is copied, a portion of the image of the original d which corresponds to the left half area of the sheet is erased.

Figure 15:
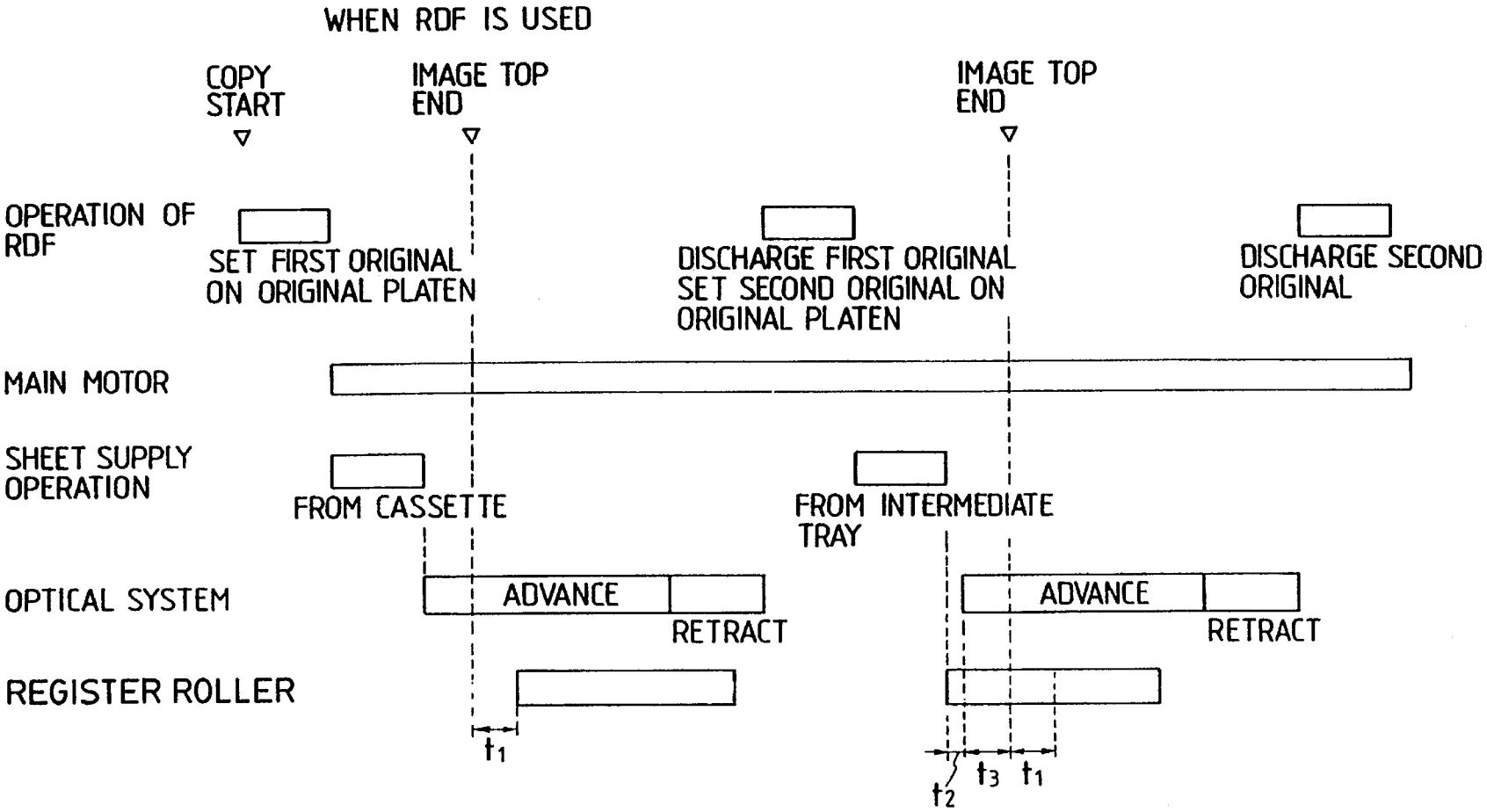
FIG. 15 is a timing chart of the sequence page copy multiple mode when the RDF is used.
Figure 20:
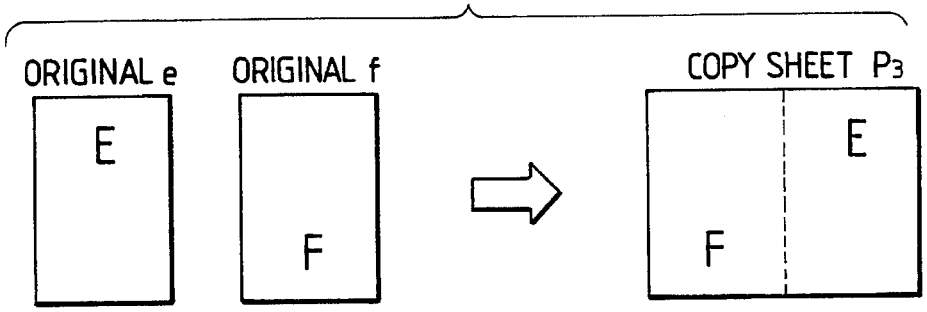
FIG. 20 is an explanatory view for explaining the image forming operation in such a case.
Figure 21:
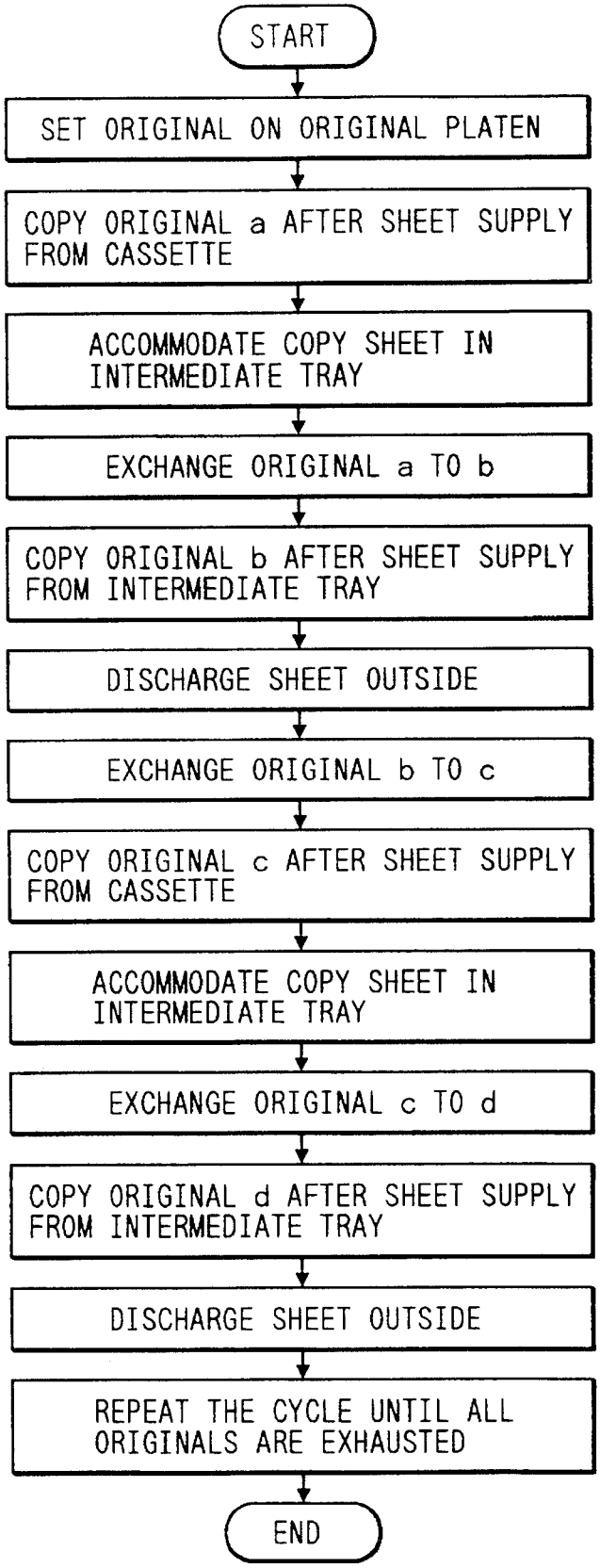
FIG. 21 is a flow chart when a number of originals are automatically handled in the sequence page copy multiple mode.

Further, in FIGS. 15 and 19, while an example that the single copy sheet P is obtained from two originals was explained, if three or more originals are used, as shown in a flow chart of FIG. 21, by continuing the copying operation while exchanging the originals successively, the copy sheets as shown in FIG. 12 or 20 can be successively obtained.

Incidentally, it should be noted that the timing of the reading of the optical system may be delayed or the timing for writing the read image onto the photosensitive drum may be delayed to obtain the copy sheet as mentioned above.

In this way, the image top end of the image formed on the photosensitive drum reaches the image forming portion after the front portion of the sheet has passed through the image forming portion, thus copying the image onto the rear portion of the sheet.

Next, a both-face sequence page copy multiple mode wherein the images of front and rear surfaces of the original are copied on the single sheet side by side will be explained.

Figure 22:
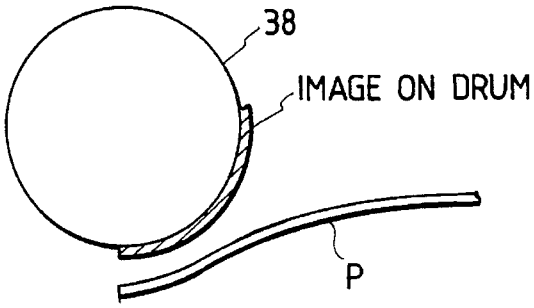
FIG. 22 is an explanatory view showing the relation between a sheet and a photosensitive drum in an image forming apparatus according to a second embodiment of the present invention.
Figure 23:
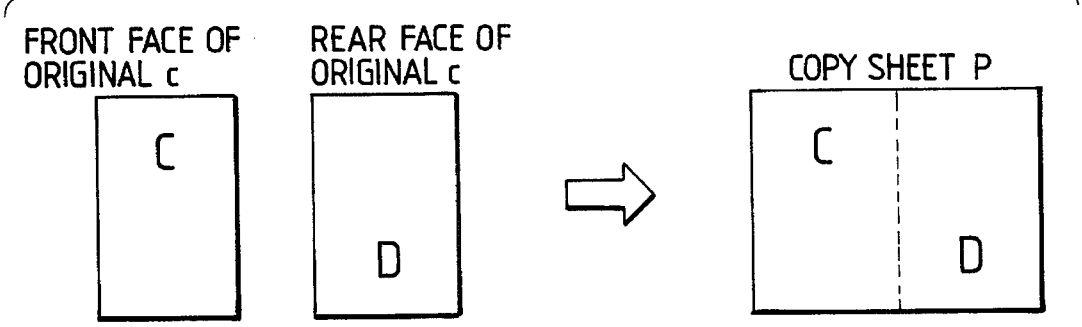
FIG. 23 is an explanatory view for explaining the image forming operation in a both-sequence page copy multiple mode.
Figure 24:
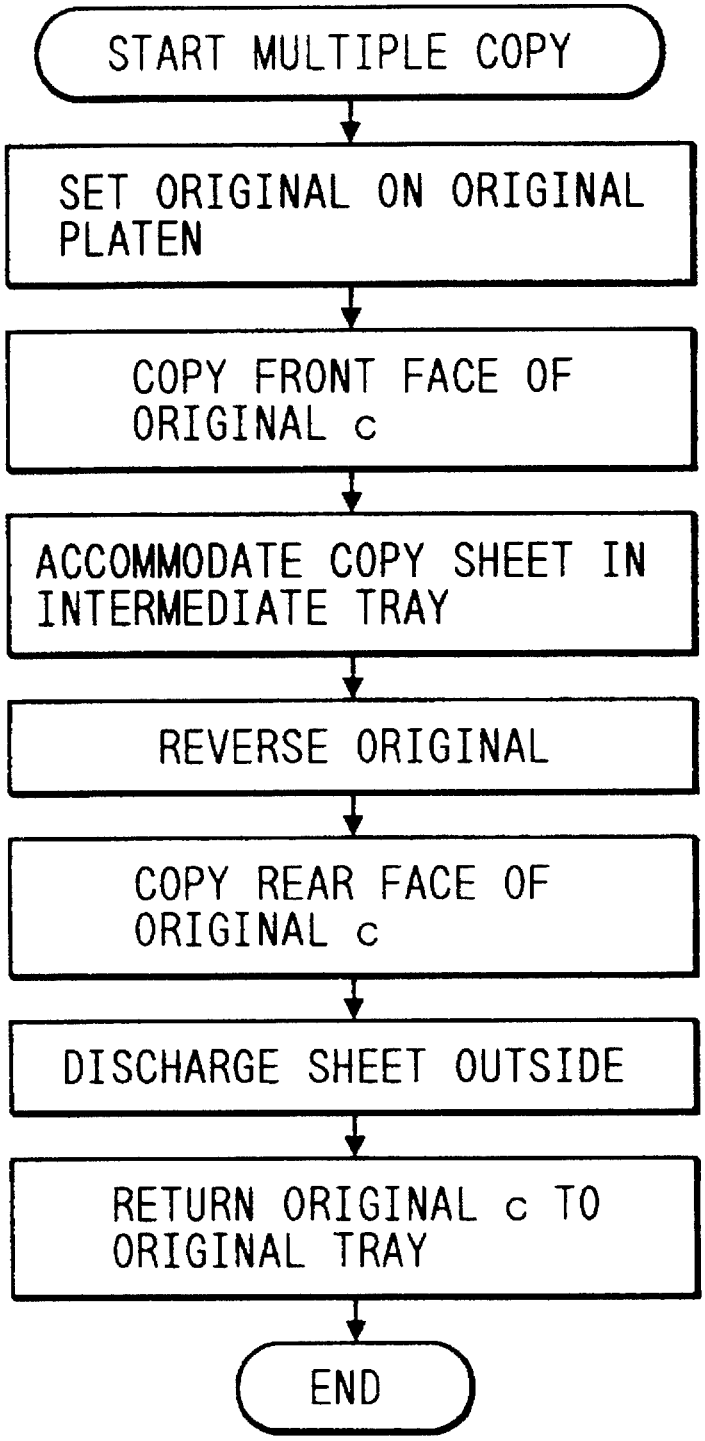
FIG. 24 is a flow chart in the both-face sequence page copy multiple mode.
Figure 25:
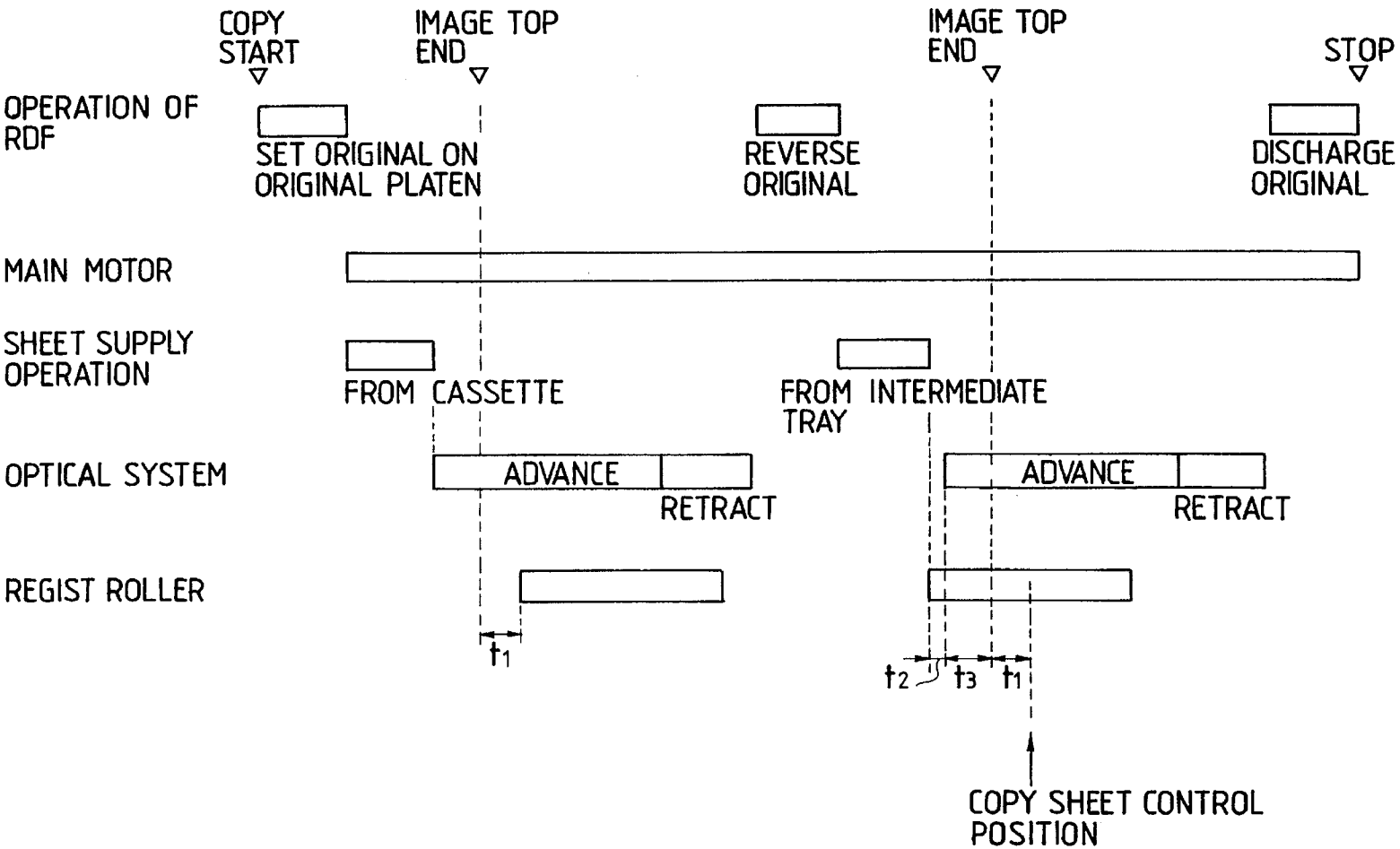
FIG. 25 is a timing chart in the both-face sequence page copy multiple mode.

In the normal multiple mode, the copy sheet as shown in FIG. 6 is obtained; however, in the both-face sequence copy multiple mode, as shown in FIG. 23, the copy sheet P can be obtained from a both-face original C (on both surfaces of which the images are formed). That is to say, the image of a front surface of the both-face original C is copied on a front portion of the sheet P and the image of a rear surface of the original C is copied on a rear portion of the sheet P. A flow chart for effecting the both-face sequence copy multiple mode is shown in FIG. 24, and a timing chart thereof is shown in FIG. 25. That is to say, when the sheet supplying operation has been finished, the optical system is started to advance. When the image top end signal is emitted from the sensor $S_2$, after a predetermined time $t_1$ has been elapsed, the control portion 86 activates the pair of register rollers 19 so as to control the leading end of the image formed on the photosensitive drum 38 being aligned with a leading end of the sheet P (see FIG. 22).

Figure 26:
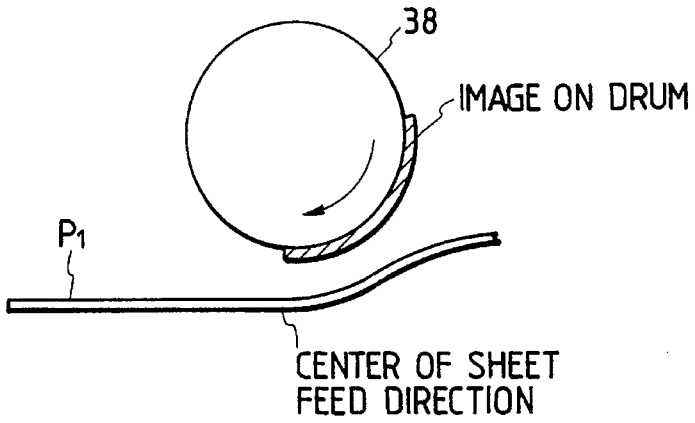
FIG. 26 is an explanatory view showing the relation between a sheet and a photosensitive drum in such a case.

Then, when the original C is reversed and the reversed original is set on the platen by means of the RDF, the sheet P is re-supplied from the intermediate tray 31. When the re-supplying operation is finished, the register rollers 19 are activated to feed the sheet P to the copying portion 20. After the predetermined time $t_2$ has been elapsed, the optical system starts to advance to control the optical system and the register rollers 19 so that the image is copied on the rear portion of the sheet P. In this case, the positional relation between the image formed on the photosensitive drum 38 and the sheet P is shown in FIG. 26. As shown in FIG. 26, the sheet P precedes the image on the photosensitive drum 38.

Now, explaining the time $t_2$ between the activation of the register rollers 19 and the initiation of the advancement of the optical system, since a time $t_3$ from the initiation of the advancement of the optical system (emission of OFF signal from the home position sensor $S_1$) to the detection of the fact that the optical system is positioned at the image top end position by means of the sensor $S_2$ is a time previously set regarding the optical system, and a time ($t_1+t_2=t_3$) corresponds to a time when the sheet is conveyed by the register rollers by a half of the length of the sheet P and has a value previously set, and further, as mentioned above, the time $t_1$ corresponds to the time from the emission of the signal from the image top end sensor $S_2$ to the activation of the register rollers 19, the time $t_2$, i.e., the time from the activation of the register rollers 19 to the initiation of the advancement of the optical system can easily be set.

Incidentally, when the copy magnification is changed, the time $t_3$ from the initiation of the advancement of the optical system to the detection of the fact that the optical system is positioned at the image top end position by means of the sensor $S_2$ is also varied. Consequently, it is apparent that the time $t_2$ is also varied.

Further, if a DC motor is used to drive the optical system, the time $t_3$ is dispersed more or less; however, if a stepping motor is used to drive the optical system, the time $t_3$ can be known accurately. The image can be correctly copied on the rear portion of the sheet P.

In order to set the time $t_3$, a time from the initiation of the advancement of the optical system to the detection of the image top end by means of the sensor $S_2$ is previously measured, and the measured data is stored in the control portion 86. Alternatively, the time $t_3$ can be calculated by the control portion 86 on the basis of the building-up feature of the optical system. If the stepping motor is used to drive the optical system, since the time $t_3$ can be previously calculated regarding each of the copy magnifications, by storing the calculated values in the control portion 86, the calculation of the time can be omitted during the copying operation.

Figure 27:
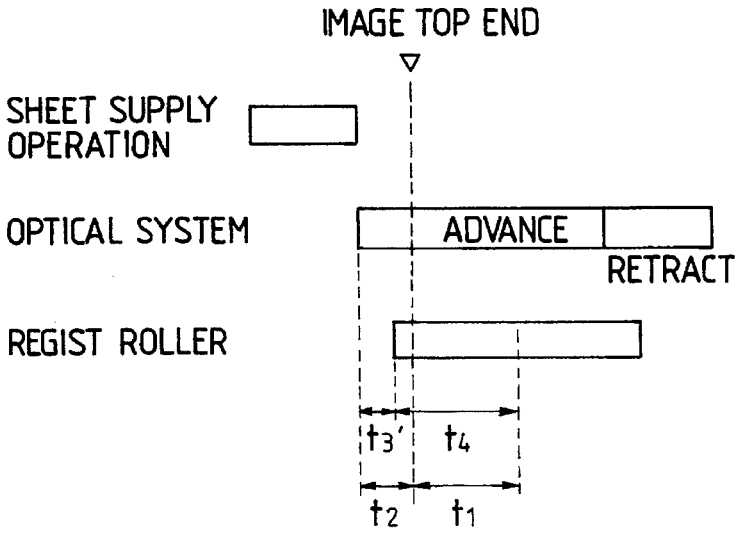
FIG. 27 is a timing chart when a copy magnification is changed.

Further, as shown in FIG. 27, in accordance with the copy magnification, in some cases, the timing of the initiation of the advancement of the optical system will be faster than the timing of the activation of the register rollers 19; however, since the position onto which the image is transferred is already known (i.e., a central portion of the sheet P) and the aforementioned times $t_1$, $t_2$ are also known a time $t'_3$ (the time difference between the initiation of the advancement of the optical system and the activation of the register roller 19) can be sought.

In this way, the copy sheet as shown in FIG. 23 can be correctly obtained.

Figure 28:
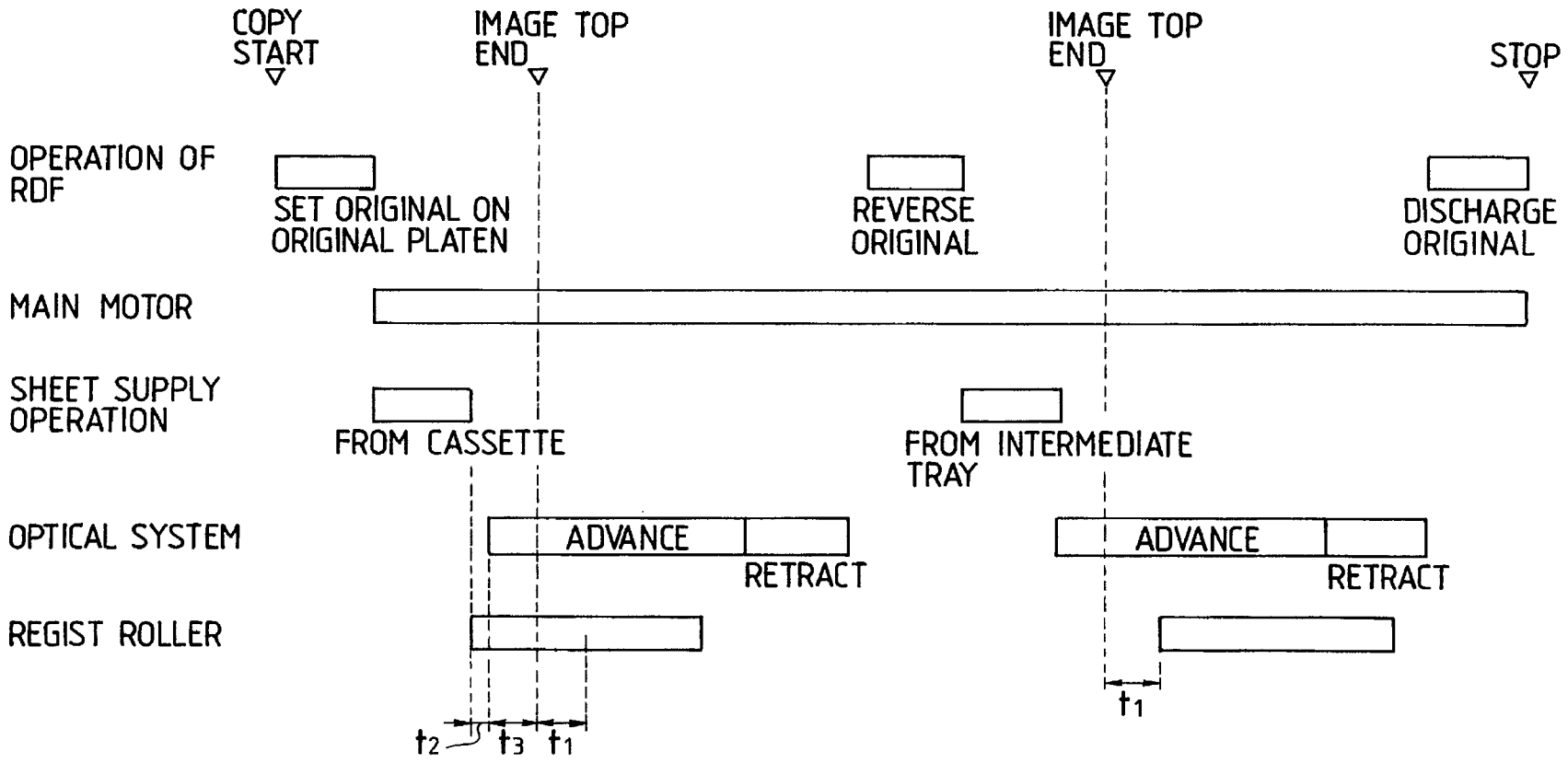
FIG. 28 is a timing chart when the sequence of the images on front and rear faces of the originals is reversed in left and right.

While an example that the both-face sequence page copy multiple mode is effected by shifting the timing of the copying operation regarding the second surface in the multiple copy was explained, the both-face sequence page copy multiple mode can be effected by shifting the timing of the copying operation regarding the first surface in the multiple copy. A timing chart therefor is shown in FIG. 28. By doing so, a copy sheet P as shown in FIG. 29 can be obtained.

Further, although not illustrated in the timing charts, undesired portions of the image can be erased by the laser unit 32. Explaining with reference to FIG. 23, when the image of the front surface of the original c is copied, a portion of the image of the original which corresponds to the right half area of the copy sheet P is erased, and, when the image of the rear surface of the original c is copied, a portion of the image of the original which corresponds to the left half area of the sheet is erased.

Figure 29:
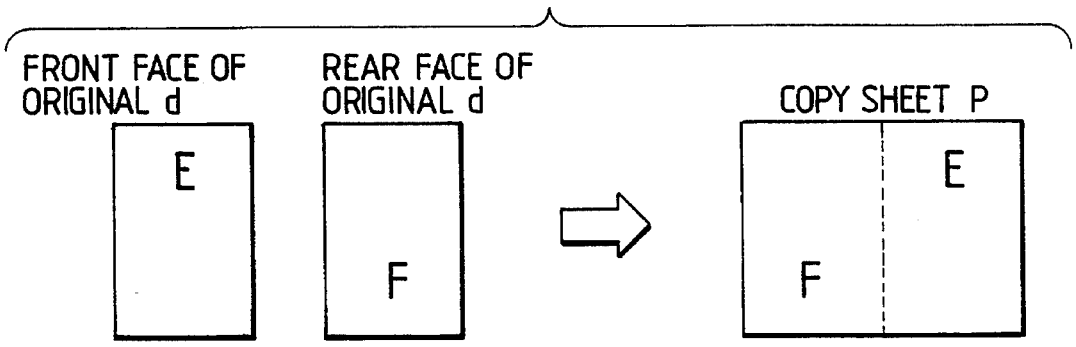
FIG. 29 is an explanatory view for explaining the image forming operation in such a case.
Figure 30:
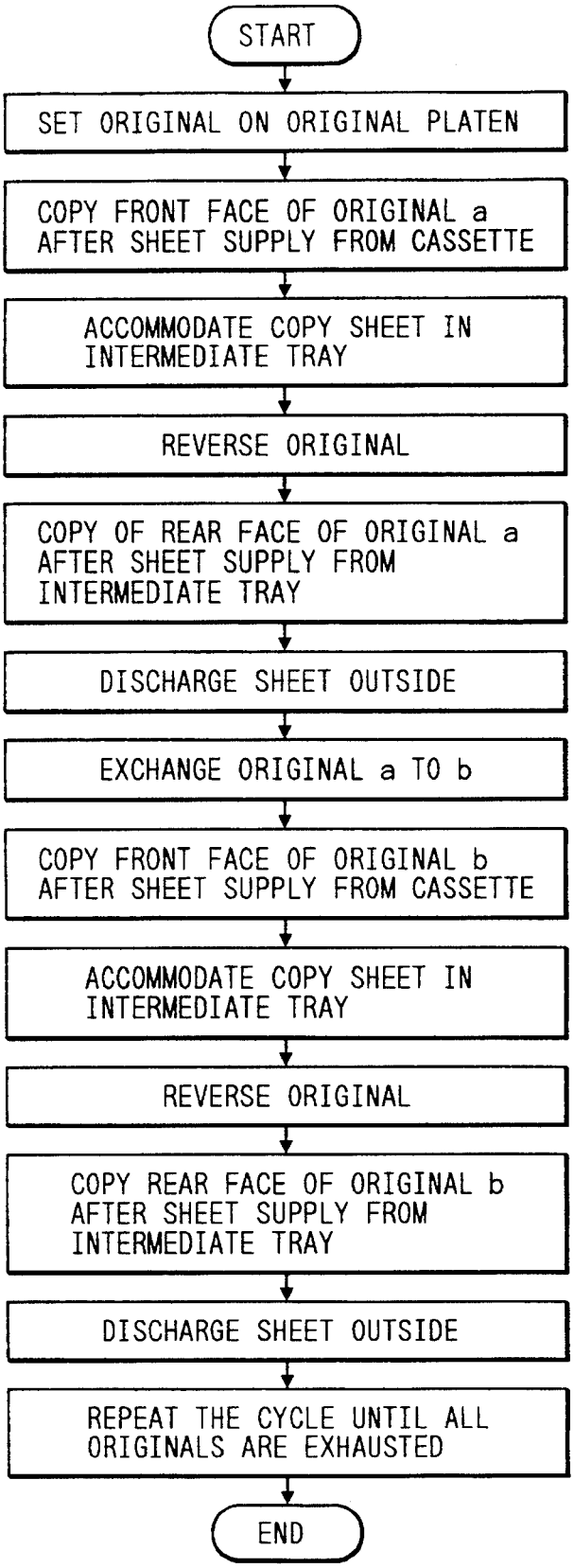
FIG. 30 is a flow chart when a number of originals are automatically handled in both-face sequence page copy multiple mode.

Further, in FIGS. 26 and 28, while an example that the single copy sheet P is obtained from the images of the front and rear surfaces of the original was explained, if two or more originals are used, as shown in a flow chart of FIG. 30, by continuing the copying operation while exchanging the originals successively, the copy sheets as shown in FIG. 23 or 29 can be successively obtained.

Further, in FIGS. 24, 25 and 28, while an example that the both-face sequence copy multiple mode is effected by copying the image of the front surface of the original S and then by copying the image of the rear surface of the same original was explained. In this case, when the originals S were stacked on the stacking tray 100, the originals were set with the front surfaces thereof turned upside, and thereafter, the RDF was driven to rest the original S on the platen with the front surface thereof turned downside, and then, the RDF was driven to reverse the same original and to rest the original on the platen with the rear surface thereof turned downside. However, the RDF may be driven to rest the original on the platen with the rear surface thereof turned downside and then to reverse the same original and to rest the original on the platen with the front surface thereof turned downside. In this way, by changing the method for stacking the originals on the stacking tray 100, the copy sheet as shown in FIG. 29 can be obtained, without performing the sequence as shown in FIG. 28 (i.e., firstly, the timing is shifted by the time $(t_1+t_2+t_3)$).

What is claimed is:

1. An image forming apparatus for forming images on a single sheet side by side, comprising:

an original reading means having an optical system for reading a first original image and a second original image;

an image forming means for forming the first and second original images read by said original reading means on a sheet;

a sheet conveying means having register means for feeding the sheet in register with operation of said image forming means, for conveying a blank sheet to said image forming means so as to form a first image on the blank sheet;

a re-supplying means for directing the sheet on which the first image was formed by said image forming means to said image forming means again by re-circulation of the sheet through said sheet conveying means so as to form a second image on the sheet; and a timing control means wherein said register means is operated in register with the operation timing of said optical system for the first original image to form the first original image on one half of the sheet, and then said optical system is operated in register with the operation timing of said register means to form the second original image on another half of the sheet, whereby the first and second original images are formed on one sheet side by side sequentially.

2. An image forming apparatus according to claim 1, wherein the first original image is formed on a front portion of the sheet and the second original image is formed on a rear portion of the same sheet.

3. An image forming apparatus according to claim 1, wherein the second original image is disposed on one of a second original and a rear surface of a first original.

4. An image forming apparatus according to claim 1, wherein the first original image is disposed on one of a first original and a front surface of the first original.

5. An image forming apparatus according to claim 2, wherein when forming the second original image the timing for the conveyance of the sheet is faster than the timing of the singular image formation by a half of a length of the sheet.

6. An image forming apparatus according to claim 1, further comprising an original conveying means for automatically supplying the first and second original images one by one to said original reading means.

7. An image forming apparatus according to claim 6, further comprising a glass platen on which the first and second original images conveyed by said original conveying means are rested.

8. An image forming apparatus for forming images on a single sheet side by side, comprising:

an original reading means having an optical system, for reading an image of an original;

an image forming means for forming the image read by said original reading means on a sheet;

a sheet conveying means having register means for feeding the sheet in register with operation of said image forming means, for conveying the sheet to said image forming means;

a re-supplying means for directing the sheet on which a first image was formed by said image forming means to said image forming means again by re-circulation of the sheet through said sheet conveying means to form a second image on said sheet;

a timing control means wherein said register means is operated in register with the operation timing of said optical system for the first original image to form the first original image on one half of the sheet, and then said optical system is operated in register with the operation timing of said register means to form the second original image on another half of the sheet, whereby the first and second original images are formed on one sheet side by side sequentially; and an original conveying means for automatically supplying the original one by one to said original reading means, for reversing front and rear surfaces of the original read by said reading means and for directing the reversed original to said original reading means again.

9. An image forming apparatus according to claim 8, further comprising a glass platen on which the first and second original images conveyed by said original conveying means are rested.

10. An image forming means according to claim 8, wherein said original conveying means comprises a recycling type conveyor in which the first and second original images are returned to a sheet supply tray in an original page sequence after being read by said original feeding means.

11. An image forming method for forming images on a single sheet side by side, comprising the steps of:

reading a first original image by operating an optical system;

forming the first original image read in said reading step;

conveying a blank sheet, in register with timing of the image forming by a register means, to form the first original image on the sheet;

reading a second original image by operating said optical system; and directing the sheet on which the first original image was formed for forming the second original image on the sheet by said optical system, by re-circulation of the sheet;

wherein said register means is operated in register with the operation timing of said optical system for the first original image to form the first original image on one half of the sheet, and said optical system is operated in register with the operation timing of said register means to form the second original image on another half of the sheet, whereby the first and second original images are formed on one sheet side by side.

12. An image forming method according to claim 11, wherein the first original image is formed on a front portion of the sheet and the second original image is formed on a rear portion of the same sheet.

13. An image forming apparatus method to claim 12, further comprising erasing means for erasing an image area on an original corresponding to half part of the sheet when the original image is the same size as the sheet.

14. An image forming method according to claim 12, wherein the second original image is disposed on one of a second original and a rear surface of a first original.

15. An image forming method according to claim 12, wherein the first original image is disposed on one of a first original and a front surface of the first original.

16. An image forming apparatus, for forming images on a single sheet side by side, comprising:

an original reading means for reading a first original image and a second original image;

an image forming means for forming the first and second original images read by said original reading means on a sheet;

a sheet conveying means for conveying a blank sheet to said image forming means so as to form a first image on the blank sheet, said sheet conveying means comprising a register roller and said original reading means comprising an optical system, wherein when forming the first original image on a front part of the sheet, said register roller is rotated after time period $t_1$ after said optical system reaches a tip end position of the first original image, and when forming the second original image on a rear part of the sheet, said optical system is moved after time period $t_2$ after said register roller rotates; and a re-supplying means for directing the sheet on which the first image was formed by said image forming means to said image forming means again by re-circulation of the sheet so as to form a second image on the sheet;

wherein a sum of $(t_2+t_3+t_1)$ is a time period T necessary for said register roller to feed the sheet by a length corresponding to half thereof, that is, $t_2=T-(t_1+t_3)$ where $t_3$ is defined as a time period after said optical system started operation thereof to said optical system reached to the tip end position of the image.

17. An image forming apparatus according to claim 16, wherein the time period $t_2$ varies in correspondence to a predetermined magnification.

18. An image forming method comprising the steps of:

reading a first original image;

forming the first original image read in said reading step;

conveying a blank sheet to form the first original image on the sheet;

reading a second original image; and directing the sheet on which the first original image was formed for forming the second original image on the sheet, by re-circulation of the sheet;

wherein the timing for the formation of the first original image and the timing for the formation of the second original image are changed to form the first and second original images on the single sheet side by side, and wherein the first original image is formed on a front portion of the sheet and the second original image is formed on a rear portion of the same sheet, and wherein when forming the first image on a front part of the sheet a register roller is rotated after time period $t_1$ after an optical system reaches a tip end position of the first original image, and when forming the second image on a rear part of the sheet the optical system is moved after time period $t_2$ from when the register roller rotated, and wherein a sum of $(t_2+t_3+t_1)$ is a time period T necessary for the register roller to feed the sheet by length corresponding to half thereof, that is, $t_2=T-(t_1+t_3)$ where $t_3$ is defined as a time period from said reading step started thereof to reading the tip end position of the image.

19. An image forming method comprising the steps of:

reading a first original image;

forming the first original image read in said reading step;

conveying a blank sheet to form the first original image on the sheet;

reading a second original image; and directing the sheet on which the first original image was formed for forming the second original image on the sheet, by re-circulation of the sheet;

wherein the timing for the formation of the first original image and the timing for the formation of the second original image are changed to form the first and second original images on the single sheet side by side, and wherein the first original image is formed on a rear portion of the sheet and the second original image is formed on a front portion of the same sheet, and wherein when forming the first image on a rear part of the sheet an optical system is moved after time period $t_2$ from when the register roller rotated, and when forming the second image on a front part of the sheet, the register roller is rotated after time period $t_1$ when the optical system reaches the tip end position of the image, and wherein a sum of $(t_2+t_3+t_1)$ is a time period T necessary for the register roller to feed the sheet by length corresponding to half thereof, that is, $t_2=T-(t_1+t_3)$ where $t_3$ is defined as time period from said optical system started operation thereof to said optical system reached to the tip end position of the image.

20. An image forming apparatus for forming images on single sheet side by side, comprising:

an original reading means for reading a first original image and a second original image;

an image forming means for forming the first and second original images read by said original reading means on a sheet;

a sheet conveying means for conveying a blank sheet to said image forming means so as to form a first image on the blank sheet, said sheet conveying means comprising a register roller and said original reading means comprising an optical system, wherein when forming the first original image on a rear part of the sheet, said optical system is moved after time period $t_2$ after said register roller is rotated, and when forming the second original image on a front part of the sheet said register roller is rotated after time period $t_1$ after said optical system reaches the tip end position of the image; and a re-supplying means for directing the sheet on which the first image was formed by said image forming means to said image forming means again by re-circulation of the sheet so as to form a second image on the sheet;

wherein a sum of $(t_2+t_3+t_1)$ is a time period T necessary for said register roller to feed the sheet by a length corresponding to half thereof, that is, $t_2=T-(t_1+t_3)$ where $t_3$ is defined as a time period from said optical system started operation thereof to said optical system reached to the tip end position of the image.

21. An image forming apparatus for forming images on a single sheet side by side, comprising:

an original reading means having an optical system for reading a first original image and a second original image;

an image forming means for forming the first and second original images read by said original reading means on a sheet;

a sheet conveying means having register means for feeding the sheet in register with operation of said image forming means, for conveying a blank sheet to said image forming means so as to form a first image on the blank sheet;

a re-supplying means for directing the sheet on which the first image was formed by said image forming means to said image forming means again by re-circulation of the sheet through said sheet conveying means so as to form a second image on the sheet; and a timing control means wherein said optical system is operated in register with the operation timing of said register means for the first original image to form the first original image on one half of the sheet, and then said register means is operated in register with the operation timing of said optical system to form the second original image on another half of the sheet, whereby the first and second original images are formed on one sheet side by side sequentially.

* * * * *

UNITED STATES PATENT AND TRADEMARK OFFICE

CERTIFICATE OF CORRECTION

PATENT NO. : 5,510,888 Page 1 of 2

DATED : April 23, 1996

INVENTOR(S) : Tadayoshi KUGE

It is certified that error appears in the above-indentified patent and that said Letters Patent is hereby corrected as shown below:

COLUMN 5:

Line 46, "to" should be deleted.

COLUMN 6:

Line 9, "rotated," should read --rotated.--.

COLUMN 7:

Line 67, "S" should be deleted.

COLUMN 8:

Line 33, "known" should read --known,--.

COLUMN 10:

Line 21, "known" should read --known,--.

UNITED STATES PATENT AND TRADEMARK OFFICE

CERTIFICATE OF CORRECTION

PATENT NO. : 5,510,888 Page 2 of 2

DATED : April 23, 1996

INVENTOR(S) : Tadayoshi KUGE

It is certified that error appears in the above-indentified patent and that said Letters Patent is hereby corrected as shown below:

COLUMN 12:

Line 53, "apparatus method" should read --method--.

COLUMN 13:

Line 25, "claim 16," should read --claim 20,--.

Signed and Sealed this

Seventeenth Day of September, 1996

Bruce Lehman

*Attest:*

BRUCE LEHMAN

*Attesting Officer*

*Commissioner of Patents and Trademarks*